United States Patent [19]

Risgin, deceased et al.

[11] 4,443,791

[45] Apr. 17, 1984

[54] SELF-COMPENSATING GAS DETECTION APPARATUS

[76] Inventors: Ojars Risgin, deceased, late of Grass Lake, Mich.; by Geraldine J. Risgin, administratrix, 4800 W. Ellsworth Rd., Ann Arbor, Mich. 48103

[21] Appl. No.: 867,071

[22] Filed: Jan. 5, 1978

[51] Int. Cl.[3] ..... G08B 17/10

[52] U.S. Cl. ..... 340/634; 73/23; 422/98

[58] Field of Search ..... 340/632, 633, 634; 324/71 SN, 71.6; 73/23, 27 R; 23/254 E; 422/95, 96, 97, 98

[56] References Cited

U.S. PATENT DOCUMENTS

| | | | |
|---|---|---|---|
| 3,801,972 | 4/1974 | Ho Kim et al. | 340/633 |
| 3,864,628 | 2/1975 | Klass et al. | 340/634 |
| 3,961,248 | 6/1976 | Kawamura | 340/633 |
| 4,012,692 | 3/1977 | Eicker | 324/71 SN |

*Primary Examiner*—John W. Caldwell, Sr.
*Assistant Examiner*—Daniel Myer
*Attorney, Agent, or Firm*—James M. Deimen

[57] ABSTRACT

Alarm-indicating gas detection apparatus including a first semiconductor gas-sensing element having one electrical property which varies significantly with increasing concentrations of a first undesirable gas and less significantly with increasing concentrations of a second undesirable gas and a second semiconductor gas-sensing element having the same electrical property which varies significantly with increasing concentrations of the second gas and less significantly with increasing concentrations of the first gas. The electrical property of both gas-sensing elements tends to vary similarly with age and with changing conditions such as temperature and relative humidity. A compensation system is used to cancel out errors due to variations in the electrical property. Threshold circuits are used to distinguish between first and second undesirable gases and to generate alarm signals. A gas combination detection circuit generates an alarm whenever a significant concentration of both first and second gases are present or whenever a third detectable undesirable gas, such as CO, is present. A logic gating network is used to generate various alarm initiating signals. Signal-generating elements responsive to these alarm-initiating signals generate a different alarm indication for each different alarm state detected. The system may include an oxygen depletion detection system with the placement of the oxygen depletion sensor close to at least one of the first and second gas-sensing elements for usage at temperatures significantly lower than the lower operating limit normally permitted by the gas-sensing elements.

20 Claims, 5 Drawing Figures

+6 V.
+2.5V
RED
GREEN
ORANGE
YELLOW

SELF-COMPENSATING GAS DETECTION APPARATUS

BACKGROUND OF THE INVENTION

1. Field of the Invention

This invention relates to a method and apparatus for detecting the presence of one or more harmful gases and, more specifically, to an improved gas detection apparatus which can accurately distinguish between various undesirable gases and generate a highly accurate electrical output signal indicative thereof which is compensated for sensor variations in conditions such as temperature, relative humidity, aging or drift, and the like.

2. Description of the Prior Art

Industry is extremely conscious of the ever-expanding need for more reliable, precise and faster responding gas detection instruments, primarily due to the impedance provided by the increasingly stringent EPA (environmental Protection Agency) and OHSA (Occupational Health and Safety Act) regulations both of which have estabished standards specifying that the air we breathe must be relatively free of dangerous contaminants and that the environmental atmospheres to which workers are exposed must be free of toxic, noxious, combustible and other hazardous substances which might endanger the worker's health or safety.

The growing public awareness of deaths and/or property damage which may have been prevented with proper detection or measurement equipment has led to increasing activity in this area, particularly in recent years.

The gas measuring and detection instruments of the prior art have proved, as a whole, grossly inadequate to meet the needs of today's industry and the more stringent demands imposed by governmental regulations and public outrage. The need for low cost instrumentation which is portable, accurate, selective, reliable, and easy to operate over relatively long periods of time has gone virtually unfulfilled.

In addition, rather than only intermittent testing, a detector is needed which operates continuously. This is important particularly in industrial applications so that a worker can carry the detector with him through a plant or wear it on his person to sense the presence of a potentially combustible, toxic, noxious or otherwise undesirable or dangerous gas and to provide an alarm indicative thereof. While permanently mounted fixed monitors may be placed in high-risk areas, the high-risk areas must be first identified with the use of continuously operating portable instruments. It is not practical to go through a plant initially with an instrument which must be repeatedly triggered to evaluate the atmosphere, and pockets of undesirable gases may be missed easily. Thus, continuous operation is an important industrial prerequesite for the gas detection instruments of today.

Portability and continuous operation becomes particularly important in applications such as waste treatment where the workers must operate in confined spaces such as sewers and manholes; fire departments which are required to conduct surveys in all types of confined and potentially dangerous areas; shipping where compartments, holds and confined spaces must be inspected; utilities where manholes and vaults are used; construction areas where workers operate in tunnels and other underground or confined areas; chemical operations which involve tanks, vats and the like; refineries involving process areas, holding tanks, treatment facilities and the like; mining where all types of combustible, toxic, or other hazardous gases must be detected in underground operations including remote pockets or low-lying areas of mines and the like; and inspection operations of any other type of enclosed areas, gas fields, etc.

Therefore, the need for a continuously operable, highly reliable portable gas detector usable in all such applications has existed for some time and continues unfilled to the present day.

Furthermore, modern gas detection instruments must be of a relatively low cost so that they can find wide usage in the various industries and not add greatly to the cost of the overall product or service provided. Ease of operation, operating time and life, and ease of maintenance are also important from these standpoints.

Modern gas detection instruments must additionally be highly accurate, extremely reliable, fast-acting, and, in most instances, must be selective, i.e., able to distinguish between one or more type of undesirable gas which may be present. These demands are of utmost importance due to the ever-increasing public demand for increased worker safety and clean air standards and additional incentive is provided due to the substantial financial penalties which may be assessed under the standards established by federal, state, and local governments for non-compliance therewith.

Most of the gas detector devices of the prior art suffer from one or more of the following drawbacks. The chemical types of gas detectors, including the calorimetric systems, are relatively slow-acting and are non-continuous. A sample of gas must be introduced through a powdery agents into a tube and a visible color change or stain occurs. The length of the stain must be physically measured to determine the relative concentration or contamination level. Thus, systems relying on chemical reactions are slow, non-continuous and costly. Furthermore, the tubes, once stained, are not re-usable.

Optical systems which rely on the infrared absorption spectra of a gas are not easily portable and are too expensive to install at even fixed locations in a plant. In the absence of portability, continuous sampling and prompt indication of toxicity levels, optical systems are not feasible for the widespread usage required under today's conditions.

Another type of system utilized in the prior art to detect the presence of toxic gases is gas chromotography in which a sample of gas is injected into an absorption column and the reaction is timed and absorbed. Thus, a slow response and non-continuous sampling are obvious drawbacks of gas chromotography systems. Such systems are non-portable, highly costly and not usable in most of today's industrial applications under discussion.

Still another prior art system is electrochemical gas detection wherein an oxidation-reduction reaction takes place in the fuel cell with the gas being sampled serving as one electrolyte. The fuel cell generates a current proportional to the electrolyte concentration and this type of system requires a pump and filter, reference electrodes, oxidation and reduction electrodes, feedback voltage circuitry and read-out circuitry as well as the secondary electrolyte, etc. This type of system, however, cannot selectively identify carbon monoxide, is quite complex and not generally satisfactory for all types of applications. Furthermore, such a system is normally unable to select between different types of gases, is relatively costly, and its readings are not without error induced by various conditions such as changing temperatures, humidity, aging and the like.

It is not enough that modern systems be highly accurate, reliable and continuously operable, but portable units must also be able to operate without interruption for recharging for at least an eight hour period and the system must operate continuously to be able to detect small pockets or intermittent emissions of undesirable gases which periodic sampling would be unable to detect with any degree of reliability.

One of the most recent and most popular types of gas sensors for detecting the presence of various gases is the semiconductor catalytic gas-sensing element such as the Taguchi gas sensor, made by the Figaro Engineering Company, Inc. of Osaka, Japan, and which is disclosed in U.S. Pat. No. 3,676,820, which is incorporated by reference herein. Similar types of semiconductor catalytic sensors are now available and could be used as well. Such sensors are typically composed of a bulk n-type metal oxide such as tin oxide, zinc oxide, etc. and the sensor decreases its electrical resistance when it absorbs the oxidizing or combustible gases such as hydrogen, carbon monoxide, methane, propane, alcohol, volatile oil and a settling as well as carbon-dust containing air or smoke. This decrease is usually large enough to be measured without amplification.

For these reasons, the semiconductor catalytic-type gas sensor has found wide usage as an alarm device and such applications as fire alarms, alcoholic breath analyzers, gas leak detection, ventillator control, etc. As pointed out in U.S. Pat. No. 3,906,473, one difficulty with gas detectors using such elements is that, with the sensor operating in its high temperature range, its response to carbon monoxide and methane is substantially lower than for other more complex hydrocarbon molecule gases. Furthermore, the sensitivity of the equalibrium method is less than is desired for some purposes and, in fact, is not sufficiently accurate or reliable for many of the applications required in industry.

Furthermore, it has been found that such semi conductor catalytic gas-sensing elements which utilize the principle whereby the electrical resistance or some similar property changes with concentration of a particular gas to which the sensing element is susceptible have proven to be unreliable and give erroneous information since the same electrical property such as resistance is found to change significantly with such external conditions as temperature, relative humidity, aging or drift, and the like, thus rendering gas detection devices employing these gas-sensing elements relatively unreliable and inaccurate under many sets of circumstances frequently encountered in industry and in fact dangerous if reliance is placed on the accuracy thereof without knowledge of the conditions which can render the readings erroneous.

It is also desirable to be able to detect either a first or a second undesirable gas and some level of concentration of the sum of these gases with the same sensing elements, wherever possible, but this has heretofore been unachievable with any degree of accuracy and reliability, particularly in the portable, low-cost, continuously operating detection systems required today.

Furthermore, the prior art exhibits a need to combine gas detection instruments for sensing combustible, toxic or other noxious gases with a compact system for sensing oxygen deficiency but the standard prior art units utilizing standard detection cells such as the micro fuel cell manufactured by the Teledyne Instrument Company usually become inoperative below some predetermined lower temperature operating limit such as 32 degrees Fahrenheit and it is desirable to be able to utilize today's gas-sensing instruments at significantly lower temperatures.

The present invention eliminates nearly all of the deficiencies of the prior art gas detection systems and provides a self-compensating apparatus for detecting and identifying one or more undesirable gases and produce a highly accurate and reliable electrical output signal indicative thereof, the output signal being compensated for errors due to variations in conditions such as temperature, relative humidity, aging or drift, and the like.

SUMMARY OF THE INVENTION

The apparatus of the present invention for detecting and indicating the presence of at least a predetermined minimum concentration of at least one undesirable gas within a given area includes a first semiconductor gas-sensing means having at least one electrical property which changes significantly in response to the presence of at least the one undesirable gas even though this one electrical property may tend to vary with changes in temperature, relative humidity, age or drift, etc. A second semiconductor gas-sensing means is also provided which has a similar electrical property which changes significantly in response to the presence of a different gas but changes less significantly in response to the presence of the first undesirable gas and the electrical property of the second gas-sensing means also tends to vary in a similar manner with changes in conditions such as temperature, relative humidity, age or drift and the like.

The apparatus of the present invention includes an electrical circuit means responsive to the electrical property of the first and second semiconductor gas-sensing means for generating at least one reliable electric output signal compensated for variations in temperature, relative humidity, age or drift and the like, and this compensated electrical output signal is indicative of the relative concentration of said at least one undesirable gas, at least in the absence of significant concentrations of a different gas. Means are provided for establishing at least one predetermined threshhold range indicative of less than said predetermined minimum concentration of said at least one undesirable gas and means responsive to the compensated electrical output signal being beyond the established threshhold range are provided for indicating the presence of at least said predetermined minimum concentration of said at least one undesirable gas within said given area for alarm purposes.

In the preferred embodiment of the present invention, the first semiconductor catalytic gas-sensing element may be particularly suited for detecting combustible gases such as methane while the second semiconductor gas-sensing element may be particularly suited for detecting toxic gases such as hydrogen sulfide and the like.

A Howland circuit supplies current to the gas-sensing electrodes of the first and second semiconductor gas-sensing elements and electrical bridge circuit means and comparator circuits are used for generating a highly accurate compensated difference signal indicative of the identity and relative concentration of the particular gas detected, at least in the relative absence of the other gas, and this signal may be supplied to a pair of threshhold detecting circuits for generating a first alarm state signal whenever the first gas is detected and a second alarm stage signal whenever the second gas is detected.

Comparator circuitry associated with the Howland circuit may be used to sense a combined drop in the resistance of both gas-detecting elements which could occur, for example, whenever a predetermined concentration of both the first and second undesirable gases are present simultaneously or, alternatively, whenever a third desirable gas, such as carbon monoxide to which both gas-sensing elements respond to a lesser extent is present, for generating a third alarm state indication and responsive to the detection thereof, although this signal is not normally compensated for conditions such as temperature, relative humidity, aging or drift and the like.

Additionally, heater control circuitry may be provided for supplying current to the heater electrodes of the first and second semiconductor gas-sensing elements and control means including a feedback loop may be provided for closed loop control of the heater current. A warm-up detection circuit may be used to disable the generation of various alarm signals during the initial warm-up period and to provide a higher heater current during the warm-up period, the heater current circuitry being responsive to termination of the warm-up period for reducing the amount of heater current by changing the threshhold in the feedback control network.

Yet further, the invention may include an oxygen deficiency detection system which may include temperature compensation circuitry, on-the-spot accuracy calibration circuitry, and separate alarm indication means. Furthermore, the oxygen deficiency sensing element may be placed in close proximity to one or both of the semiconductor catalytic gas-sensing elements to permit the oxygen deficiency fuel sensing cell to be utilized at temperature levels far below the normal operating range for which such sensors are designed.

The detection and indication apparatus of the present invention may also include gating circuitry responsive to the various alarm state indication signals for initiating various audio and/or visual alarms indicative of the predetermined alarm state detected. Therefore, different colored lights may be energized or de-energized for the various alarm states and the different audio tones and/or combinations thereof, may be generated depending upon the particular gas or alarm state detected. Lastly, alarm conditions caused by low battery voltage, etc., may also be detected and used to initiate alarm indications indicative thereof, if desired.

The system of the present invention also contemplates a method for compensating gas detecting and indicating instruments which employ a single semiconductor catalytic gas-sensing element by adding a second semiconductor catalytic gas-sensing element and appropriate circuitry for cancelling out errors due to varying conditions such as temperature, relative humidity, aging or drift and the like to provide a highly accurate compensated gas detection signal.

Other advantages and meritorious features of the present invention will be more fully understood from the following detailed description of the drawings of the preferred embodiment, the appended claims and the drawings, which are briefly described hereinbelow.

DESCRIPTION OF THE PREFERRED EMBODIMENT

Figure 1:
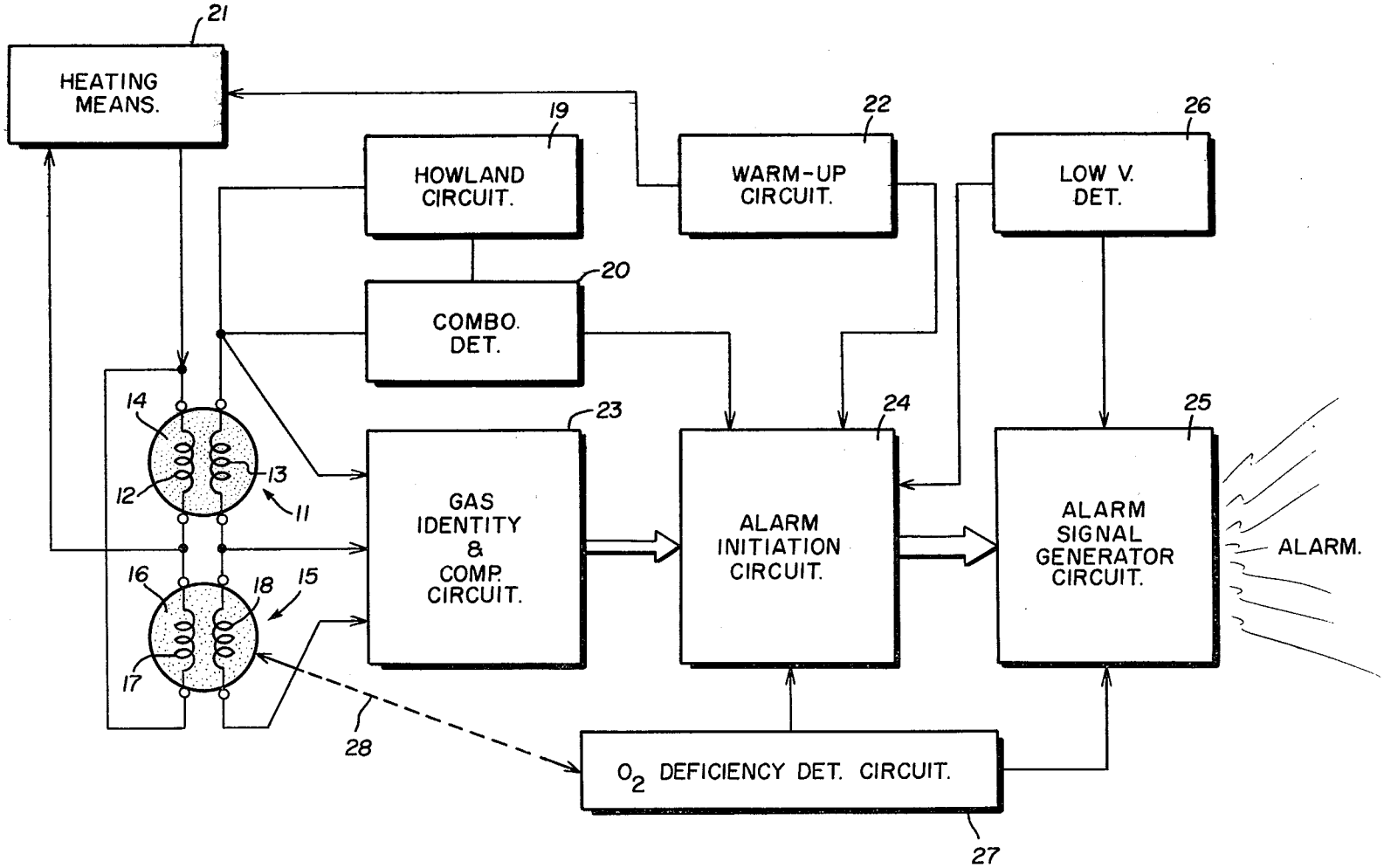
FIG. 1 is a block diagram illustrating the preferred embodiment of the gas detecting apparatus of the present invention.

The gas detection apparatus of the preferred embodiment of the present invention will now be described with reference to the block diagram of FIG. 1. In the preferred embodiment of the present invention, the gas detection apparatus is portable and housed within a light-weight protective housing having a rechargeable battery pack. The unit is capable of being worn on a person's belt or the like and it weighs less than two pounds.

The gas detection apparatus of the present invention includes a first semiconductor catalytic gas-sensing device 11, such as a conventional Taguchi gas sensing semiconductor device (TGS) which is manufactured by Figaro Engineering, Inc. of Osaka, Japan. In the preferred embodiment of the present invention, the first gas-sensing device 11 is a TGS 812 semiconductor catalytic gas sensor having a pair of coils or electrical elements 12, 13 embedded in a bead or body of semiconductor material 14. One of the pair of electrical elements is used as a heating element 12 and the other electrical element is used as a gas-sensing electrode 13. The characteristics of the first gas-sensing device 11 is such that the electrical resistance of the gas-sensing element or electrode 13 is normally at a predetermined normal level such as 80K ohms under normal clean-air conditions, but whose electrical resistance drops significantly when the gas-sensing device 11 is exposed to a first undesirable gas, for example a combustible gas such as methane ($CH_4$).

A second semiconductor catalytic gas-sensing device 15 is also included and may also be a Taguchi gas-sensing semiconducting catalytic device such as TGS 711 manufactured by the Figaro Engineering, Inc. of Osaka, Japan, but similar semiconductor catalytic gas-sensing devices of other manufacturers could also be used. The second gas-sensing device 15 similarly includes a pair of coils or electrical elements 17, 18 embedded in a bead or body of semiconductor material 16. The first coil or winding is used as a heating element 17 while the second coil or winding functions as a gas-sensing electrode 18 whose electrical resistance varies with the relative concentration of gas detected. In a TGS 711, for example, the normal electrical resistance of the gas-sensing electrode 18 is approximately 80K ohms under normal clean-air conditions but drops significantly in the presence of a second undesirable gas, for example a toxic gas such as hydrogen sulfide ($H_2S$), to indicate the detection or presence thereof.

In the preferred embodiment of the present invention, the properties of the first and second gas-sensing devices 11, 15 respectively is as follows. The electrical resistance of the first gas-sensing element 13 has a normal clean-air resistance which drops more significantly in the presence of a combustible gas such as methane but which drops considerably less significantly in the presence of toxic gases such as hydrogen sulfide whereas the gas-sensing electrode 18 of the second gas-sensing device 15 has a normal electrical resistance which drops more significantly in the presence of toxic gases such as hydrogen sulfide but much less significantly in the presence of combustible gases such as methane.

Furthermore, both the first gas-sensing device 11 and the second gas-sensing device 15 have the electrical resistance of their respective gas-sensing elements 13, 18, tending to vary in a similar manner with similar changes in other conditions such as varying temperatures, relative humidity, dew point, aging, or drift, changing battery potential, and the like. One of the features of the present invention utilizes the fact that similar variations in changing conditions which cause similar variations in the resistance of the sensing electrodes 13, 18 of the different gas-sensing devices 13, 15 respectively, so that such variations and the errors resulting therefrom can be offset from one another to produce a highly accurate, error-compensated output reading having a much greater reliability than any heretofore achievable in the prior art.

A voltage-to-current converter system such as the Howland circuit of block 19 may be used to supply current to the gas-sensing electrodes 13, 18 of the first and second gas-sensing devices 11, 15, respectively. Such a circuit is described in *Modern Operational Circuit Design* by John I. Smith, Wiley-Interscience, New York, N.Y., 1971 at page 154+ and such book is incorporated by reference herein.

Circuitry may also be provided, as indicated by block 20, for detecting a predetermined total combined drop in the resistances of the first and second sensing elements 13, 18, such as may occur when a combination of combustible and toxic gases are present or, alternatively, when a TGS 813 is substituted for a TGS 812 such that the first gas-sensing element is less sensitive to combustible gases than previously described but the carbon monoxide sensing ability of both the first and the second devices 11, 15 are similar, so that the circuit of block 20 can be used to detect a third undesirable gas such as carbon monoxide (CO).

Heating circuit means, as represented by block 21, may be provided for supplying the necessary heating current to the heat-generating coils 12, 17 of the first and second gas-sensing devices 11, 15 respectively, and a warm-up circuit 22 may be provided for varying the amount of heating current during the initial warm-up period and for disabling certain alarm initiation circuits during such period, as hereinafter described.

In the preferred embodiment of the present invention, gas identification and compensation circuitry, as represented broadly by block 23, are provided for measuring the relative changes in the resistances across the gas-sensing elements 13 and 18 of the gas-sensing devices 11, 15 respectively, for identifying the particular gas present and, if desired, the relative concentration thereof, at least with respect to some predetermined minimum threshhold level below which the quantity of undesirable gas may be regarded as negligible or insignificant. The circuitry of block 23 generates a highly accurate electrical output signal compensated for errors due to variations in conditions such as temperature, relative humidity, aging and the like and this compensated signal may be processed in the alarm initiation circuitry and gating logic of block 24 for use in generating various alarm signals in the alarm signal generating circuitry of block 25 as desired.

A low voltage detector circuit, as represented by block 26, may be added for monitoring the state of the battery voltage and generating a signal indicative of the status thereof, and an oxygen deficiency detection circuit 27 may also be included in the portable gas detector system of the present invention, if desired. The dotted arrow 28 indicates that the oxygen deficiency detection micro fuel cell may be placed in close proximity to at least one or both of the two gas-sensing devices 11, 15 so that the heat generated therefrom may be used to enable the oxygen detection circuitry of block 27 to operate well below its normal temperature minimums, as hereinafter described.

Figure 2:
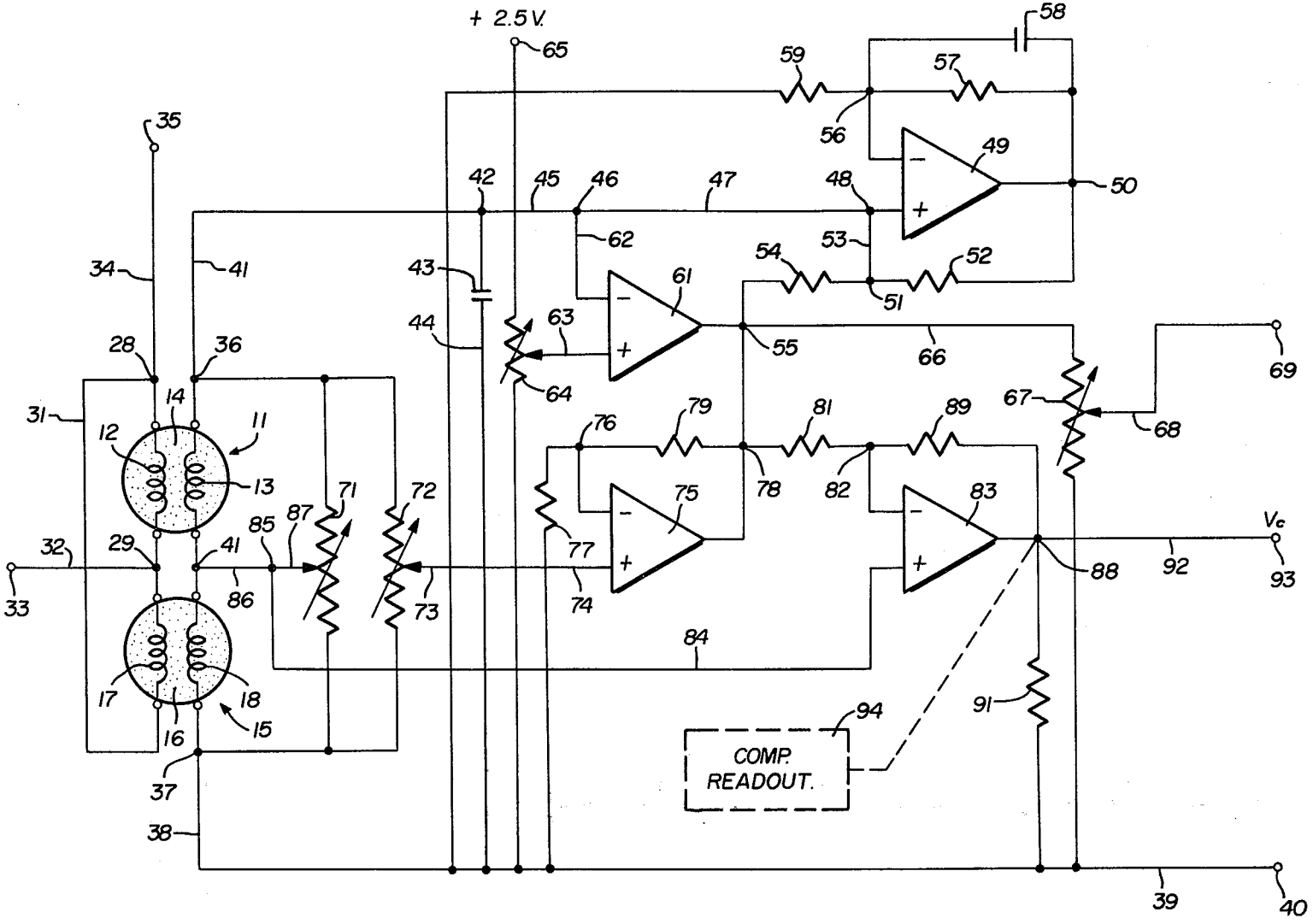
FIG. 2 is an electrical schematic diagram of the first and second semiconductor gas-sensing elements of FIG. 1 together with the circuitry generally included within the blocks designated Howland Circuit, Combo Detection, and Gas Identification and Compensation Circuitry.

The voltage-to-current generating Howland circuit of block 19, the combination detection circuit of block 20 and the gas identification and compensation circuitry of block 23 will now be described with reference to the electrical schematic diagram of FIG. 2. One terminal of the heater element 12 of the first semiconductor catalytic gas-sensing device 11 is connected directly to a heater current input node 28 and the opposite terminal of the heating element 12 is connected directly to a junction node 29 which in turn is connected to the first terminal of the heating element 17 of the second semiconductor catalytic gas-sensing device 15 whose opposite terminal is connected, via lead 31, back to the heater current input node 28. A feedback path is established from the junction node 29 between the second terminal of the heater element 12 and the first terminal of the heater element 17 and includes a feedback lead 32 which is fed back to the heater means circuit of block 21, as hereinafter described, via feedback node 33. The heater current input node 28 is connected via lead 34 to the current input node 35 which is also included within the heating means of block 21, as hereinafter described with reference to the circuit of FIG. 3.

The first terminal of the gas-sensing element or electrode 13 of the first semiconductor gas-sensing device 11 is connected directly to a current sensing input node 36 while the opposite terminal of the first sensing electrode 13 is connected via junction node 41 directly to the first terminal of the sensing element or electrode of the second semiconductor gas-sensing device 15. The opposite terminal of the second sensing electrode 18 is connected directly to a node 37 and node 37 is connected via lead 38 to a negative grounding lead 39 which is connected via node 40 back to the negative supply terminal of the battery of FIG. 3 as hereinafter described.

The junction of the second terminal of the first gas-sensing element or coil 13 and the first terminal of the second gas-sensing coil or element 18 is designated by the reference numeral 41 which will be further described hereinafter. The current input node 36 is supplied with current via lead 41 which is connected to a first node 42. Node 42 is connected directly to one plate of a capacitor 43 whose opposite plate is connected via lead 44 to the negative grounding lead 39. Node 42 is also connected via lead 45 to a negative input node 46. The negative input node 46 is connected via lead 47 to a positive input node 48 which forms a portion of the voltage-to-current converter of the present invention which is, in the preferred embodiment of FIG. 2, a Howland circuit, as hereinafter described. Node 48 is connected directly to the non-inverting input of a conventional operational amplifier 49 whose output is taken from output node 50. Output node 50 is connected to a positive feedback node 51 through a positive feedback resistor 52. Feedback node 51 is connected directly to the non-inverting input node 48 via lead 53 and is also connected via resistor 54 to an output node 55, as hereinafter described.

The output node 50 is also connected back to a negative or inverting input node 56 through the parallel combination of a negative feedback resistor 57 and a capacitor 58. The negative input node 56 is connected directly to the inverting input of the operational amplifier 49 and is also connected through a resistor 59 to the negative grounding lead 39.

The mathematical derivation or explanation of the operation of the voltage-to-current conversion characteristics of the Howland circuit is too difficult to explain herein, but the circuit functions so as to respond to the changing impedence of the gas-sensing elements 13, 18 of the semiconductor catalytic gas-sensing elements 11, 15, respectively, and attempts to maintain a constant current to the sensing current input node 36 by varying the voltage across the sensors and the circuitry associated therewith as sensor impedence values change with varying gas concentrations.

The combo of gas detection circuitry of block 20 will now be briefly described. An operational amplifier 61 has its inverting input connected via lead 62 to node 46 for monitoring the voltage at the current input node 36 and hence across the combination of gas-sensing elements 11, 15. The non-inverting input of the operational amplifier 61 is connected via an adjustable tap input lead 63 which may be adjustibly varied to control the gain setting of the amplifier 61 by selectively positioning it along a potentiometer or variable resistor 64 which is connected between a +2.5 volt source of potential, which is generated as hereinafter described, via a voltage reference node 65 and the negative grounding lead 39. The output of the gain amplifier 61 is connected directly to an output node 55 and, as previously described, node 55 is connected to one terminal of a resistor 54 whose opposite terminal is connected to the positive feedback node 51. Output node 55 is also connected via lead 66 to one terminal of a gain potentiometer or variable resistor 67 whose opposite terminal is connected directly to the negative grounding lead 39. A variably positionable tap element 68 can be selectively positioned along the potentiometer 67 to control the gain of the output signal from node 55 at the output of amplifier 61 and the gain-controlled signal at output node 69, for use as hereinafter described.

The operation of the combination (combo) detection circuitry of block 20 of FIG. 1 will now be briefly described with reference to the electrical schematic of FIG. 2. The voltage tap lead 63 may be used to select the resistance of potentiometer 64 to establish a positive threshhold at the non-inverting input of the operational amplifier 61. The value of this threshhold is chosen so that, under normal operating conditions, the voltage drop experienced by either the first semiconductor gas-sensing device 11 in response to the detection of at least a predetermined concentration of a combustible gas or, alternatively, the resistance drop and hence the corresponding voltage change resulting therefrom experienced by exposure of the second semiconductor catalytic gas-sensing device 15 to at least a predetermined concentration of a toxic gas will not, in and of itself, be sufficient to exceed the established threshhold.

If, however, the first and second gas-sensing devices 11 and 15 are exposed to an environment or atmosphere containing a considerable concentration of both combustible and toxic gases causing both of their resistances to drop, the cumulative or total drop in resistance will cause a sufficient voltage change at node 36, and hence at node 46, to fall below the established threshhold at the non-inverting input thereby causing the output of the operational amplifier 61, which is taken from node 55, to increase in proportion to the amount by which the voltage at node 46 falls below the threshhold established via tap 63 and gain potentiometer 64, causing the signal on lead 66 to rise and the voltage appearing across resistor 67 to increase. This causes the gain-controlled output signal at node 69 to increase as well, and this signal may be used, as hereinafter described, to initiate an alarm indication indicative of the fact that a predetermined combination of undesirable gases is present.

Similarly, if a different type of semiconductor catalytic gas-sensing device were used, such as the substitution of a TGS 813 for the TGS 812 unit used as the first gas-sensing device 11, the sensitivity of both the first and second gas-sensing devices 11, 15, respectively, to a third undesirable gas, such as carbon monoxide (CO), could be detected since each of these elements exhibits a similar electrical resistance drop with exposure to carbon monoxide. In this manner, the threshhold value established at the non-inverting input of the amplifier 61 could be established so that whenever the combination of the first and second semiconductor catalytic gas-sensing devices 11 and 15 sense a predetermined concentration of a third undesirable gas such as carbon monoxide in a given area or environmental atmosphere, the output of the combo amplifier 61 will increase and can be used to generate an alarm indication indicative of the presence of the third undesirable gas, by means hereinafter described.

An electrical bridge-type circuit is connected across the first and second series coupled, gas-sensing devices 13, 15 as hereinafter described. A first resistive means such as a potentiometer 71 is connected across the series-connected gas-sensing elements 13, 18 of the first and second semiconductor gas-sensing devices 11, 15 respectively, as hereinafter described to form the first leg of the electrical bridge. One terminal of the first potentiometer 71 is connected to the sensing current input node 36 and the opposite terminal of the potentiometer 71 is connected to the grounding node 37. Similarly, a second resistive means such as potentiometer 72 is connected in parallel with potentiometer 71 to form the second leg of the electrical bridge such that one terminal of the potentiometer 72 is connected to the sensing current input node 36 and its opposite terminal is connected to the grounding node 37. A variably or selectively positionable tap 73, associated with the potentiometer 72 and hence the second leg of the bridge circuit, is connected via lead 74 directly to the noninverting input of a conventional operational amplifier 75 whose inverting input is connected directly to an inverting input node 76. Node 76 is connected through a resistor 77 to the negative grounding lead 39 and the output of the operational amplifier 75 is connected directly to an output node 78. Node 78 is connected through a feedback resistor 79 to the negative input node 76 and through a resistor 81 to the inverting input node 82 of a second operational amplifier 83 used as a difference amplifier, as known in the art. The non-inverting input of the difference amplifier 83 is connected via lead 84 to a node 85. Node 85 is connected via lead 86 to the junction node 41 at the junction of the sensing elements 13, 18 of the first and second sensing devices 11, 15 respectively, and simultaneously to the selectively positionable voltage tap 87 associated with the potentiometer 71 comprising the first leg of the bridge circuitry previously described. The output of the difference amplifier 83 is supplied to output node 88. Node 88 is connected via feedback resistor 89 to the inverting input node 82; through a pull-up resistor 91 to the negative grounding lead 39; and via output lead 92 to an error-compensated electrical output signal node 93, for use as hereinafter described.

The operation of the gas identification and compensation circuitry of block 23 of FIG. 1 will now be briefly described with reference to the circuitry of FIG. 2. The bridge circuitry comprising potentiometers 71 and 72 which are connected across the gas-sensing elements 13, 18 of the first and second semiconductor catalytic gas-sensing devices 11, 15, respectively, operate briefly as follows. This first potentiometer tap 87 is used to establish a balance between the resistances of the elements 13 and 18 under "clean air" or whatever normal operating conditions are defined for use of the instrument. The second potentiometer tap 73 is used to establish a zero point for the particular devices being used and the amplifiers 75 and 83 operate to produce an error-compensated output signal $V_c$ at node 93, as briefly described hereinbelow.

The signal $V_c$ must be compensated over all normal operating ranges of relative humidity such that if the relative humidity or dew point in the environment being tested changes, there is no change in the compensated signal $V_c$ even though both the resistance of the first sensing element 11 and the second sensing element 18 change. Similarly, the resistance of both sensing elements 13 and 18 tend to change with time or age, commonly referred to as "drift", typically causing the clean air resistance to vary from 60K ohms to 80K ohms over an eight hour period or the like. Lastly, the signal $V_c$ must be compensated for temperature variations which typically cause the resistance values to fall with increased temperature, and all of this error compensation results from the fact that these electrical properties or changes in the impedence or resistance of the first element 13 correspond roughly to those of the second sensing element 18 and the bridge circuit arrangement and amplifiers associated therewith tend to cause such errors to cancel each other out so that the difference signal produced at node 88 is an error-compensated signal independent of variations in conditions such as relative humidity, temperature, aging or drift, and the like.

It will be noted that the signal on lead 84, which is applied to the non-inverting input of the difference amplifier 83, contains the intelligence information and threshhold values are established by the other circuitry so that if the signal present on lead 84 is below the threshhold established at the inverting input of amplifier 83 via node 82, then at least a predetermined concentration of a first undesirable gas, for example, a toxic gas such as $H_2S$ has been detected by the gas-sensing device 15 whereas if the signal on lead 84 is above the predetermined threshhold established at the inverting input via node 82, then at least a predetermined concentration of a second undesirable gas, for example, a combustible gas such as methane has been detected by the first gas-sensing device 11.

Under normal conditions, or in a "clean air" environment, neither the combustible gases nor the toxic gases are present in sufficient concentrations to alter the resistance of their respective gas-sensing elements 13, 18 so that the signal on lead 84 will be approximately equal to the threshhold signal established at the inverting input of difference amplifier 83 via node 82 causing the error-compensated output signal $V_c$ at node 88 to be at a value indicative of the absence of both of the gases. The error-compensated electrical output signal $V_c$ at node 93 will, as hereinafter described, be utilized by various threshhold detection circuits and gating logic to initiate various alarm indications depending upon the type of gas detected. As indicated by the dotted block 94, an error-compensated read-out device such as a conventional meter, an oscilloscope, a curve tracer, or the like, capable of monitoring the voltage at node 88 can be used to show a signal on either side of the "clean air" value so as to indicate a relatively accurate measure of not only the type of gas present but also of the relative concentration or quantity thereof, at least in the absence of a significant quantity of the other undesirable gas.

The heating circuitry of block 21, warm-up circuitry of block 22, low voltage detection circuitry of block 26 and power supply circuitry of the system of FIG. 1 will now be described with reference to the schematic diagram of FIG. 3. A source of potential 95, such as a conventional, rechargeable six volt battery, has its negative terminal connected via lead 96 to the negative grounding lead 39, previously described, and its positive terminal connected to a manually positionable on-off switch 97 having a contact arm 98 which is normally closed on a contact to complete a current path between the positive terminal of the battery 95 and a +6 volt voltage distribution node 99. The +6 volt node 99 is connected via lead 100 to a +6 volt supply terminal 101 for use in the circuit of FIG. 5, as hereinafter described, and to a voltage distribution lead 102 for supplying the +6 volt potential to the circuitry of FIG. 3. A conventional +2.5 volt voltage regulator 103 is connected between the +6 volt distribution node 99 and the negative grounding lead 39 for establishing a +2.5 volt reference which is outputted via lead 104 to a +2.5 volt distribution node 105. Node 105 is connected via lead 106 to a +2.5 volt reference terminal 107, which is used as hereinafter described in FIGS. 4 and 5, and to a +2.5 volt reference lead 108 for supplying the +2.5 volt reference potential to portions of the circuit of FIG. 3.

The low voltage detection circuit of block 26 of FIG. 1 will now be briefly described. The +6 volt supply lead 102 is connected to one terminal of a first voltage divider resistor 109 whose opposite terminal is connected to a voltage divider node 110. Voltage divider node 110 is also connected to one terminal of the second voltage divider resistor 111 whose opposite terminal is connected to the negative grounding lead 39 via lead 112. The voltage divider node 110 is also connected to a positive input node 113 through a resistor 114 and node 113 is connected directly to the non-inverting input of an operational amplifier 115 via lead 116. The output of the operational amplifier 115 is supplied to an output node 117, and output node 117 is connected back, via feedback resistor 118, to the positive input node 113 for hysteresis purposes. The inverting input of operational amplifier 115 is connected to the +2.5 volt reference lead 108 through a resistor 119 and the operational amplifier 115 functions as a threshhold comparator, as known in the art. The feedback resistor 118 provides hysteresis to prevent oscillation and instability and to provide a snap-action effect at the output of the amplifier 115. The output of the amplifier 115 is supplied to node 117 which is also connected, via output lead 121, to a low voltage warning output node 122 for use as hereinafter described.

In operation, so long as the power supply 95 retains a sufficient charge, the voltage presented at the non-inverting input of the comparator 115 via the voltage divider effect of resistors 109, 111 and pull-up resistor 114, will remain greater than the voltage presented at the inverting input via resistor 119 causing the output of the comparator 115 to maintain a normally low state. Therefore, the presence of a low signal at output node 122 indicates that the battery is sufficiently charged for normal operation and is safe and reliable to use. If the charge on the battery 95 should fall below some predetermined low voltage threshhold, established by the voltage divider 109, 111 as previously described, then the output of the comparator 115 will rapidly switch to a high state and a high at output node 117 and hence at node 122 will indicate the existence of a low voltage condition or low battery charge warning or alarm condition and can be used, as hereinafter described, to indicate same.

The warm-up circuitry of block 22 of FIG. 1 will now be described with reference to the schematic diagram of FIG. 3. The warm-up circuit of block 22 includes a conventional operational amplifier 123 having its output connected via lead 124 to an output node 125. Node 125 is connected through a hysteresis feedback resistor 126 to a positive input node 127 which is connected via lead 128 directly to the non-inverting input of the amplifier 123 and through a second resistor 129 to a node 131. Simultaneously, the output node 125 is connected via lead 132 to a warm-up status signal output node 133 for use as hereinafter described with reference to FIG. 5; and node 125 is further connected via lead 134 to one terminal of a resistor 135 whose opposite terminal is connected directly to the base of a by-pass transistor 136 to be hereinafter described with respect to the heating circuitry of block 21 of FIG. 3.

Positive input node 127 is also connected through a resistor 137 to a node 138, and node 138 is connected via lead 139 to the +6 volt supply lead 102 and througha resistor 141 to a negative input node 142. The negative input node 142 is connected via lead 143 directly to the inverting input of the operational amplifier 123. Simultaneously, node 142 is connected directly to the positive plate of a capacitor 144 whose negative plate is connected to a node 145. A switch 146 is connected in parallel across capacitor 144 such that the normally opened switch arm 147 is connected to the node 145 and the switch contact 148 is connected directly to node 142. The normally open switch arm 147 can be selectively closed upon the contact 148 to complete a current path between node 142 and node 145 for rapidly discharging the capacitor for purge purposes, testing, or the like. Node 145 and node 131 are commonly coupled directly to the negative grounding lead 39.

In operation, the warm-up circuit of block 22 operates briefly as follows. When the power switch 98 is initially closed to connect the +6 volt potential to the distribution lead 102, the capacitor 144 begins to charge and continues to do so for the duration of its predetermined time delay period which is set by the RC time constant of resistor 141 and capacitor 144. As long as the charge on the capacitor 144, which is the voltage at node 142, is less than the threshhold voltage established at the non-inverting input of the amplifier 123 via the voltage divider effect of resistors 137 and 129 via lead 128, the output of the amplifier comparator 123, which appears at node 125 will remain high causing a high signal to appear at the output node 133. After the predetermined time period has elapsed, for example, four minutes, the voltage at node 142 exceeds the threshhold value established at the non-inverting input of the amplifier 123 causing the comparator output to switch sharply low. The low at node 125 is then presented to the output node 133 for use as hereinafter described and is supplied via lead 134 back to the base of transistor 136 causing it to turn off, as hereinafter described.

The heating circuit means of block 21 will now be described with reference to the circuit of FIG. 3. A PNP transistor 151 controls the flow of heater current between the power source 95 and the heating elements 12 and 17 of the first and second semiconductor catalytic gas-sensing devices 11 and 15 respectively. The emitter electrode of transistor 151 is connected directly to the +6 volt power supply lead 102 via lead 153 while the collector electrode is connected via lead 154 to the heater current input node 35 of FIG. 2 for supplying heater current thereto. The base electrode of transistor 151 is connected through a resistor 155 to the output of an operational amplifier 156 whose output controls the operation of the transistor 151 and hence the flow of heater current to the semiconductor catalytic gas-sensing devices 11, 15, previously described.

The inverting input of the operational amplifier 156 is connected to a selectively positionable voltage tap 157 on a potentiometer resistor 158. One terminal of the potentiometer resistor 158 is connected through a resistor 159 to the +2.5 volt reference lead 108 while the opposite terminal is connected via lead 160 to the negative grounding lead 39 so that a variable threshhold may be established at the inverting input of the amplifier 156, as known in the art. The non-inverting input of the operational amplifier 156 is connected via lead 161 to a node 162 and node 162 is connected via lead 163 to the heater current feedback node 33 of FIG. 2, and simultaneously, via lead 164, to a node 165. Node 165 is connected to one terminal of a current-limiting resistor 166 whose opposite terminal is connected directly to a node 167, and node 167 is connected via lead 168 to the negative grounding lead 39. The node 165 is also connected directly to the collector of the by-pass transistor 136 whose base is connected to one terminal of the resistor 135 and whose emitter is connected directly to node 167 for effectively by-passing or shorting out the resistor 166 whenever the transistor 136 is in the conductive state, as hereinafter described.

The operation of the heating circuit of block 21 will now be briefly described with reference to FIG. 3. During the initial warm-up period, the signal at node 125 of the warm-up circuit of block 22 is high causing a high signal to be transmitted via lead 134 and resistor 135 to the base of the by-pass transistor 136 causing it to switch to a conductive state and by-pass the current-limiting resistor 166 so as to establish a direct current path between the node 162 and the grounding lead 39 via lead 164, node 165, the conducting transistor 136, node 167, and lead 168. This shorts out the resistor 166 and effectively increases heater current as hereinafter described since the voltage appearing at node 162 is essentially zero allowng all of the heater current passed by transistor 151 to be dissipated in the heating elements 12 and 17, previously described. With an extremely low voltage at node 162 being presented to the non-inverting input of the feedback error amplifier 156 via lead 161 and the signal at the inverting terminal, which is established by the position of the voltage tap 157 on the potentiometer 158 being set, the output of the operational amplifier 156 will be relatively high causing the transistor 151 to be driven hard thereby allowing a relatively high heater current to be passed to the heater elements 12 and 17 of the gas-sensing devices 11 and 15, respectively, via lead 153, the fully conducting transistor 151, lead 154, node 35, lead 34, node 28, and lead 31 of FIGS. 2 and 3.

After the predetermined warm-up period is complete, the output of the operational amplifier 123 goes low causing a low to appear at node 125. When a low signal appears at node 125, this low is transmitted via lead 134 and resistor 135 to the base of transistor 136 rendering it non-conductive and causing the current-limiting resistor 166 to be re-inserted between node 162 and the negative grounding lead 39. This raises the voltage appearing at node 162 significantly and, under normal circumstances, will still be less than the threshhold voltage established at the inverting input of the operational amplifier 156 but much closer thereto so that the output of the error amplifier 156 will drive the transistor 151 to a lesser extent so that less current is supplied to the heater electrodes 12 and 17, respectively.

After the warm-up period is completed and the resistor 166 reinserted into the current path, the feedback circuit comprising node 29, lead 32, node 33, lead 163 and node 162 will cause the voltage at node 162 to vary as the heater element resistance varies with temperature changes until the voltage presented to the non-inverting input of the operational amplifier 156 via feedback lead 161 becomes equal to the established threshhold value at the inverting input via potentiometer 158 and the tap lead 157. The conduction of transistor 151 and the heater current passed thereby will then be accurately controlled as the output of the error amplifier 156 increases and decreases as the feedback signal on lead 161 varies slightly above and below said threshhold value causing the output of the operational amplifier 156 to increase and decrease in response thereto in a conventional, closed loop, feedback-controlled manner to maintain a nearly constant desired operating temperature for both of the semiconductor catalytic gas-sensing devices 11 and 15.

Figure 4:
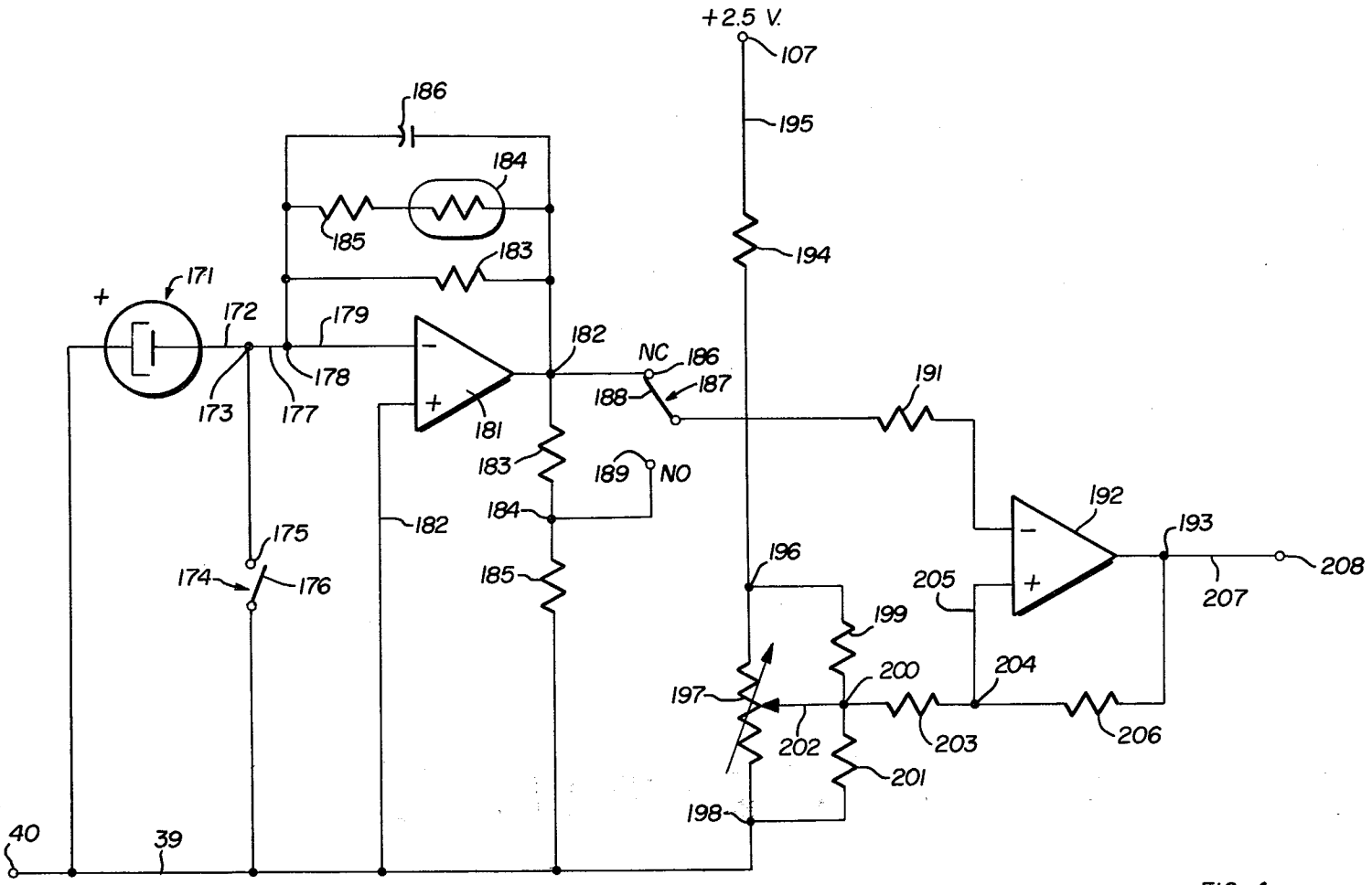
FIG. 4 is an electrical schematic diagram of the oxygen deficiency detecting circuitry of block 27 of FIG. 1.

The oxygen deficiency detection circuitry of block 27 of FIG. 1 will now be briefly described with reference to the schematic diagram of FIG. 4. In FIG. 4, an oxygen deficiency detection device 171 such as a conventional gas-detection micro fuel cell manufactured by Teledyne Instruments, has its positive terminal connected directly to the negative grounding lead 39 and its negative terminal connected via lead 172 to a node 173. In the preferred embodiment of the present invention, the actual physical location of the oxygen deficiency detection device 171 is in close proximity to at least one of the first and second semiconductor catalytic gas-sensing devices 11, 15 and/or in good thermal contact therewith for enabling the detection device 171 to be used at operational temperatures far below the lower limits normally recommended for use thereof since the electrolyte conventionally used in such cells normally freezes at 32 degrees Fahrenheit, but the heat generated by the semiconductor devices 11, 15 enables the oxygen deficiency detection device 171 to be used at substantially lower temperatures, for example, zero degrees Fahrenheit in the arrangement of the present invention.

Node 173 is coupled to the negative grounding lead 39 through a normally-closed switch 174 having a contact 175 connected directly to the node 173 and a normally-closed contact arm 176 connected directly to the negative grounding lead 39. The switch 174 may be actuated for test purposes. Node 173 is also connected via lead 177 to a negative input node 178, and node 178 is connected via lead 179 directly to the inverting input of an operational amplifier 181 whose non-inverting input is connected directly to the negative grounding lead 39 via lead 182 to create an inverting amplifier configured as a current-to-voltage converter, as conventionally known.

The output of the amplifier 181 is connected directly to output node 182 and node 182 is connected back to the negative input node 178 through the parallel combination of (1) a feedback resistor 183; (2) the series combination of a temperature compensating thermistor 184 having one terminal connected to the node 182 and its opposite terminal connected to one terminal of a resistor 185 whose opposite terminal is connected to the negative input terminal 178; and (3) through a noise-limiting capacitor 186 having its positive plate connected to the output node 182 and its negative plate connected to the negative input node 178.

The thermistor 184 compensates the signal output at node 182 for variations in the reading of the oxygen deficiency sensing element 171 output with varying temperatures. The voltage appearing at the inverting input via the negative terminal 178 and lead 177 increases with increased concentrations of oxygen and decreases with decreases in the concentration of oxygen in the given atmospheric environment or area being tested or monitored. The output node 182 is also connected to one terminal of a first voltage divider resistor 183 whose opposite terminal is connected to a voltage divider tap 184. The voltage divider tap 184 is connected to one terminal of a second voltage divider resistor 185 whose opposite terminal is connected directly to the negative grounding lead 39. The node 182 is further connected directly to the normally-closed contact 186 of a switch assembly 187 having a positionable switch arm 188 which is selectively positionable between the normally-closed contact 186 and a normally-opened contact 189 which is connected directly to node 184. The contact arm 188, when normally closed, is positioned to complete a current path between node 182 and one terminal of a resistor 191 via the normally closed contact 186 and switch arm 188. The opposite terminal of resistor 191 is connected to the inverting input of an operational amplifier 192 whose output is connected directly to an output node 193.

The voltage divider circuitry comprising resistors 183 and 185 and the switch assembly 187 provide a test mechanism for automatically calibrating the oxygen deficiency testing system under actual environmental conditions, as hereinafter described. When the switch arm 188 is in the normally-closed position on the contact 186, a voltage indicative of a "clean air" concentration of oxygen or 20.9 percent oxygen in the preferred embodiment described herein is represented by the voltage present at node 182, whereas when the test switch 187 has its contact arm 188 moved to contact the normally-opened contact 189 to complete a current path between node 184 and resistor 191, the voltage at the voltage divider node 184 represents a governmentally established danger level of 19.5 percent oxygen (or any similarly established critical value) in the environment to be tested or monitored so that the alarm can be adjusted to trip at precisely this point, as hereinafter described.

Figure 3:
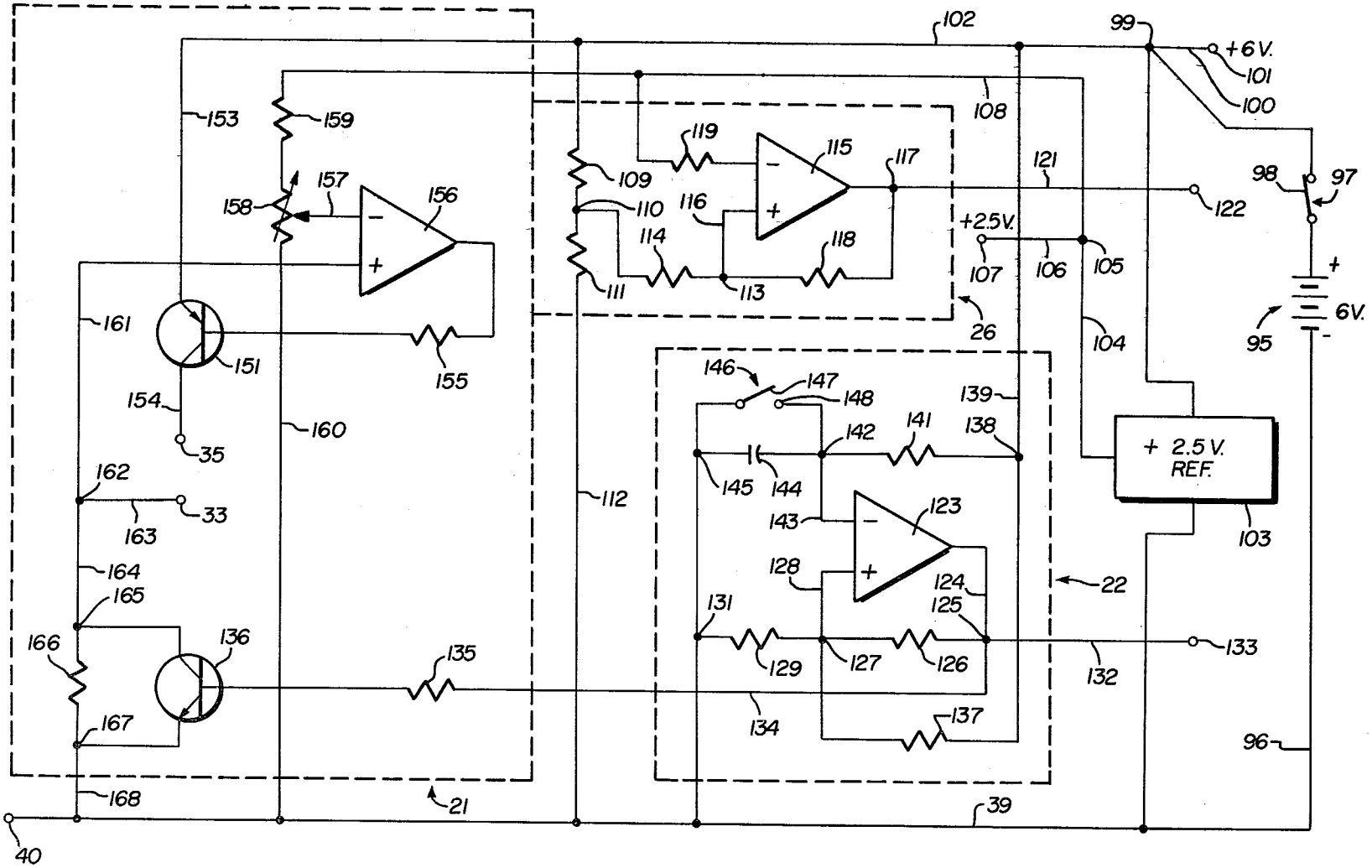
FIG. 3 is an electrical schematic diagram of the circuitry included within the blocks designated Heating Means, Warm-Up Circuitry, and Low Voltage Detection Circuitry in FIG. 1.

The calibration assembly of the oxygen deficiency detection circuit of FIG. 4 includes a first resistor 194 having one terminal connected directly to the +2.5 volt reference terminal 107 of FIG. 3 via lead 195 and its opposite terminal connected to a node 196. Node 196 is connected to one terminal of a variable resistance or calibration potentiometer 197 whose opposite terminal is connected via node 198 directly to the negative grounding lead 39.

A voltage divider combination comprising a first resistor 199 having one terminal connected to the node 196 and its opposite terminal connected to a node 200 also has a second voltage divider resistor 201 having one terminal connected to node 200 and its opposite terminal connected directly to the grounded node 198. Node 200 is connected via tap lead 202 to the selectively positionable calibration tap of the potentiometer 197 so as to vary the resistance thereof for calibration purposes, as hereinafter described. Node 200 is connected to one terminal of a pull-up resistor 203 whose opposite terminal is connected to a positive input node 204 which is connected via lead 205 to the non-inverting input of an operational amplifier 192. The output of the operational amplifier 192, which is supplied to the output node 193, is connected back via feedback resistor 206 to the positive input node 204 for hysteresis to prevent oscillation and instability and to provide a snap-action type effect at the output of the amplifier 192 which is acting as a comparator as presently configured. Output node 193 is also connected via lead 207 to the oxygen deficiency signal output node 208 for alarm indication purposes, as hereinafter described with reference to FIG. 5.

The operation of the oxygen deficiency detection circuit of FIG. 4 will be further described hereinbelow. The deficiency detection signal is supplied to the inverting input of the operational amplifier or comparator 192 via resistor 191 while a threshhold level is established at the non-inverting comparator input via lead 205 and the voltage divider combination of resistors 194, 197, 199 and 201.

When the normally-closed test switch 187 has its switch arm 188 positioned to contact the normally-opened contact 189 and complete a current path between the voltage divider node 184 and the inverting input of the comparator 192 via resistor 191, a voltage indicative of a predetermined established alarm level, such as 19.5 percent concentration of oxygen in the atmosphere or environment being tested, is presented to the inverting terminal of the comparator 192. The top 202 on the potentiometer 197 can then be manually adjusted so that the signal present at the comparator output node 193, which is normally low if the voltage reference presented to the non-inverting terminal via lead 205 is greater than the measured signal presented to the inverting input of the comparator 192 via resistor 191 indicating that more than 19.5 percent concentration of oxygen, or whatever predetermined alarm level is set is present, the output will immediately go high as the tested value and reference value become equal by manually calibrating said potentiometer 197.

The test switch 187 is then returned so that the switch arm 188 again contacts the normally-closed contact 186 to complete a current path between node 182 and the inverting input of the comparator 192 via resistor 191 so that the ouput of the comparator will remain low under normal conditions but will immediately switch to a high state as soon as the comparator 192 detects a dangerously low concentration of oxygen or an oxygen deficiency alarm condition, as previously described. The output signal at node 193 can be supplied via lead 207 to node 208 and used to generate an alarm indication, as hereinafter described with reference to FIG. 5.

Figure 5:
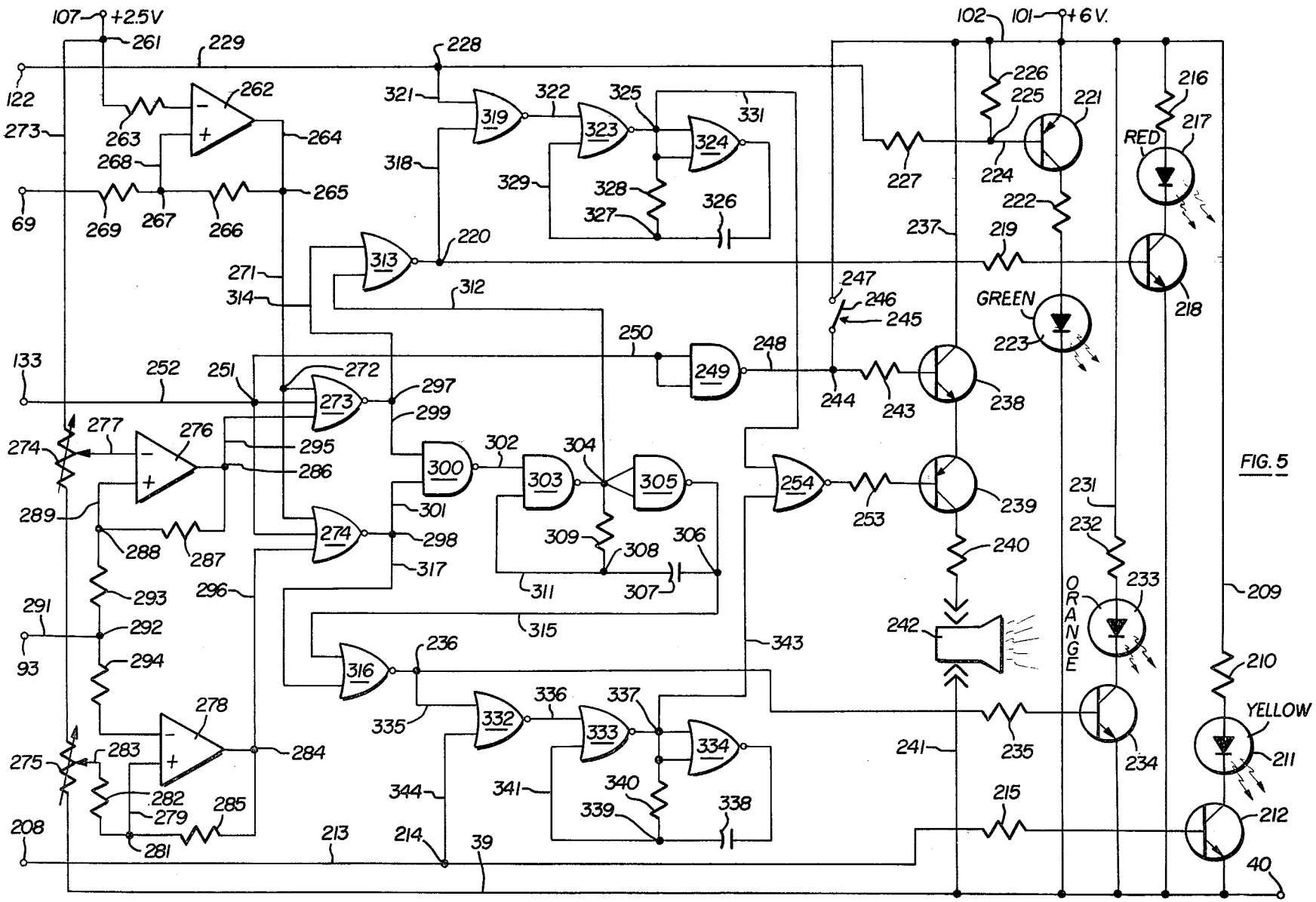
FIG. 5 is a schematic diagram of the gating logic and alarm initiating circuitry of block 24 and the alarm signal generating circuitry of block 25 of the preferred embodiment of the apparatus of the present invention as set forth in FIG. 1.

The alarm signal generation circuitry of block 25 of FIG. 1 will now be described with reference to the schematic diagram of FIG. 5 which includes various threshhold detection circuitry, logical gating circuitry, oscillator means and both audio and visual alarm indicators, as hereinafter described.

The +6 volt supply terminal 101 is connected directly to the +6 volt supply lead 102 to supply the +6 volt battery potential to the various alarm circuits hereinafter described. The +6 volt supply lead 102 is connected via lead 209 to one terminal of a resistor 210 whose opposite terminal is connected to the anode of a yellow LED (Light Emitting Diode) or, alternatively, a yellow alarm light, whose cathode is connected to a collector of a control transistor 212 whose emitter is connected directly to the negative grounding lead 39 previously described. The yellow LED 211 is the visual oxygen deficiency alarm indicator and is normally maintained off by control transistor 212 being maintained in a normally non-conductive state so long as sufficient oxygen is present in the environmental area being tested.

When, as previously described, an oxygen deficiency is detected by the oxygen sensing cell 171 of FIG. 4, the signal at the output node 193 of comparator 192 goes high causing a high to appear at node 208 via lead 207. The high from node 208 is supplied via lead 213 to a node 214 and node 214 is connected to one terminal of a resistor 215 whose opposite terminal is connected to the base or control electrode of transistor 212. When the high appears at node 208, indicating the presence of an oxygen deficiency alarm condition, transistor 212 is rendered conductive causing the LED 211 to conduct to complete a current path between the +6 volt lead 102 and the grounding lead 39 thereby turning on LED 211 and causing it to emit a yellow light indicative of the existence of an oxygen deficiency alarm condition. In other words, whenever the yellow alarm light 211 is illuminated, the instrument indicates that a condition of less than a predetermined required amount of oxygen has been detected within a given area and an alarm condition indicative thereof has been shown to exist by the illumination thereof.

The +6 volt lead 102 is also connected to one terminal of a resistor 216 whose opposite terminal is connected to the anode of a red LED 217 (or alternatively, a red light of some sort) whose cathode is connected to the collector of a control transistor 218 whose emitter electrode is connected directly to the negative grounding lead 39. The red LED is normally turned off and is illuminated whenever the presence of at least a predetermined concentration or amount of the first undesirable gas, for example, a combustible gas such as methane has been detected by the first semiconductor catalytic gas-sensing device 11. The base electrode of transistor 218 is connected to one terminal of a resistor 219 whose opposite terminal is connected to a node 220. The signal at node 220 is normally low, indicating the absence of an alarm condition, but whenever at least said predetermined amount of combustible gas is detected, the signal at node 220 goes high, as hereinafter explained, and causes control transistor 218 to conduct to establish a conductive path beween the +6 volt lead 102 and the negative grounding lead 39 causing LED 217 to become illuminated and emit red light indicative of the presence of an alarm condition representing the detection of at least said predetermined minimum concentration or amount of a first undesirable gas, for example a combustible gas such as methane.

The +6 volt supply lead 102 is also connected directly to the emitter electrode of a PNP control transistor 221 whose collector is connected to one terminal of a resistor 222 whose opposite terminal is connected to the anode of a green LED 223 (or alternatively, a green light or the like) whose cathode is then connected directly to the negative grounding lead 39. The green LED 223 is maintained normally conductive by a normally on transistor 221 to indicate the absence of a low voltage condition or, alternatively, the presence of sufficient battery voltage. However, the base electrode of transistor 221 is connected via lead 224 to a node 225 and node 225 is connected to the +6 volt supply lead 102 through a resistor 226 and simultaneously to one terminal of a resistor 227 whose opposite terminal is connected to a node 228. Node 228 is connected via lead 229 to the low voltage detector output node 122 of FIG. 3.

As previously described, so long as sufficient battery potential is present, the signal at node 122 is low and therefore the signal presented to the base electrode of transistor 221 is low causing PNP transistor 221 to be maintained in the conductive state to establish a conductive path between the +6 volt lead 102 and a negative ground lead 39 thereby illuminating the green LED 223. Whenever the comparator 115 of FIG. 3 detects a low voltage condition, the signal at node 122 goes high causing transistor 221 to become non-conductive and thereby breaking the current path between the +6 volt lead 102 and the negative ground lead 39 so as to turn off the green LED 223 to indicate a visual weak battery alarm or low voltage warning.

The +6 volt supply lead 102 is also connected via lead 231 to one terminal of a resistor 232 whose opposite terminal is connected to the anode of an orange LED 233 (or alternatively, an orange alarm light) whose cathode is connected to the collector electrode of the control transistor 234 whose emitter is connected directly to the negative grounding lead 39. The base or control electrode of transistor 234 is connected to one terminal of a resistor 235 whose opposite terminal is connected directly to a node 236. So long as the signal at node 236 is low, transistor 234 is rendered non-conductive so that the orange LED 233 is off indicating the absence of an alarm condition. However, whenever a predetermined minimum level of a second undesirable gas, for example, a toxic gas such as hydrogen sulfide is detected, the signal at node 236 goes high, as hereinafter described, causing transistor 234 to conduct and establish a current path between the +6 volt supply lead 102 and the negative grounding lead 39 which illuminates the orange LED and visually indicates the existence of said toxic gas alarm condition.

The +6 volt supply lead 102 is also connected via lead 237 to the collector of a control transistor 238 whose emitter is connected directly to the emitter of a PNP transistor 239 whose collector is connected to one terminal of a resistor 240. The opposite terminal of resistor 240 is coupled to one set of terminals of a speaker or horn for sounding an audible warning, as known in the art. An opposite set of terminal of the warning horn is coupled via lead 241 to the negative grounding lead 39 to establish a current path between the +6 volt source of potential lead 102 and the negative grounding lead 39 via lead 237, transistor 238, transistor 239, resistor 240, the warning horn 242, and lead 241.

The base or control electrode of transistor 238 is connected to one terminal of a resistor 243 whose opposite terminal is connected to a node 244. Node 244 is connected to the +6 volt supply lead 102 via a test switch assembly 245 which includes a normally-opened, manually positionable switch arm 246 having its pivoted end connected directly to node 244 and its opposite end positionable to close on a normally-opened contact 247 which is connected directly to the +6 volt supply lead 102. The closure of the movable switch arm 246 of the test switch assembly 245 on contact 247 establishes a current path between the +6 volt supply lead 102 and the base of transistor 238 rendering it conductive for testing the operation of the horn 242 under normal operating conditions and the switch arm 246 is then returned to the normally-opened position during normal operations. Node 244 is also connected via lead 248 to the output of a logical NAND gate 249 having its inputs commonly coupled via lead 250 to a node 251. Node 251 is then connected via lead 252 to the warm-up signal status node 133 of FIG. 3.

As previously described, during the initial warm-up time, as determined by the RC time constant established by capacitor 144 and resistor 141, the signal at node 133 is high and remains high during the initial warm-up stage. A high signal at node 133 causes a low to appear on lead 248 at the output of NAND gate 249 and hence a low at node 244 which renders transistor 238 non-conductive to disable the operation of the horn 242 during the initial warm-up phase of operation. Similarly, after the warm-up period is complete, the signal at node 133 goes low causing a high to appear at node 244 to switch transistor 238 to a conductive state to enable operation of the horn 242 depending upon the state of control transistor 239. This circuitry prevents the premature generation of an audio alarm condition before the sensing circuits have had sufficient time to warm up to insure increased reliability and accuracy.

The base or control electrode of the PNP transistor 239 is connected directly to one terminal of a resistor 253 whose opposite terminal is connected directly to the output of a logical NOR gate 254 having two inputs. The operation of the logical NOR gate is such that its output goes high whenever both inputs are low, but whenever either of the inputs are high, its output is low. Therefore, transistor 239 conducts only when both inputs of NOR gate 254 are low and is otherwise rendered non-conductive to turn off the audio horn or alarm 242, as hereinafter described.

The basic alarm indication generating circuitry having been described, the threshhold detection circuitry will now be briefly discussed. The +2.5 volt reference node 107 is connected directly to a node 261 and node 261 connects the +2.5 volt reference terminal 107 to the inverting input of an operational amplifier 262, which is configured as a comparator, through a resistor 263. The output of the comparator 262 is connected via lead 264 to a comparator output node 265 and output node 265 is connected via hysteresis resistor 266 back to a positive input node 267. The positive input node 267 is connected directly to the non-inverting input or positive input of the comparator 262 via lead 268 and simultaneously node 267 is connected through a pull-up resistor 269 to the combination (combo) detector output node 69 of FIG. 2 previously described. The hysteresis resistor 266 prevents oscillation and instability and provides a snap-action type effect at the output of the comparator 262 whenever the voltage at the non-inverting input reaches the threshhold voltage established at the inverting input, as conventionally known.

The voltage at output node 265 is maintained normally low so long as the combination or sum of gases detected by the first and second semiconductor catalytic gas sensing devices 11 and 15 does not cause an impedence drop sufficient to trigger the combination detection system including the comparator 61, but whenever the comparator 61 detects that a sufficient voltage drop has occurred due to a predetermined combination of first and second undesirable gases or, alternatively, the presence of at least a predetermined minimum concentration of a third undesirable gas, such as carbon monoxide, to which each sensing element 11, 15 react to a somewhat lesser extent, then the signal presented to the non-inverting input of the comparator 262 via lead 268 exceeds the value of the signal presented to inverting input via resistor 263 and causes the output signal at node 265 to go high indicating the existence of an alarm condition representing either the detection of a predetermined total amount of combined combustible and toxic gases are present or the detection of at least a predetermined minimum concentration of the third gas so as to require a different and distinct alarm indication. Comparator output node 265 is connected via lead 271 to a node 272, and node 272 is connected to a first input of a three input NOR gate 273 and simultaneously to the first input of a second NOR gate 274.

The +2.5 volt reference terminal 107 is also connected via node 261 and lead 273 to one terminal of a variable resistor or potentiometer 274 whose opposite terminal is connected to the first terminal of the second variable resistor or potentiometer 275 whose opposite terminal is connected directly to the negative grounding lead 39. A first threshhold detection circuit for detecting the presence of a predetermined concentration or quantity of a first undesirable gas, for example a combustible gas such as methane, includes a first operational amplifier 276 configured as a comparator and having its threshhold-determining inverting input connected via a selectively positionable potentiometer tap 277 to select various voltage levels on the potentiometer 274 for establishing the upper threshhold level at the inverting input of comparator 276 and a second operational amplifier 278 configured as a comparator and having its noninverting input connected via lead 279 to a node 281. Node 281 is connected to one terminal of a resistor 282 whose opposite terminal is connected to a selectively positionable voltage tap 283 which may be manually positionable to alter the resistance of the potentiometer 275 to vary the threshhold level established at the non-inverting input terminal of comparator 278, as known in the art.

The output of the comparator 278 is connected to output node 284 and node 281 is connected to node 284 through a hysteresis resistor 285. The hysteresis resistor 285 prevents oscillations and instability and provides a snap-action effect at the output node 284 when the voltage at the inverting input of the comparator 278 reaches the threshhold voltage level established at the non-inverting input thereof via lead 279. The output of comparator 276 is connected directly to output node 286 and node 286 is connected through a hysteresis resistor 287 back to a positive input node 288. Node 288 is connected directly to the non-inverting input of the comparator 276 via lead 289. The resistor 287 provides the necessary hysteresis to prevent oscillations and instability and to provide a snap-action type effect at the output node 286 of comparator 287 whenever the signal at the non-inverting input reaches the threshhold signal level established at the inverting input thereof. The compensated electrical output signal $V_c$ from node 93 of FIG. 2 is supplied via lead 291 to a common input node 292. Common node 292 is connected to the positive input node 288 of comparator 276 via resistor 293 and to the inverting input of the comparator 278 through a resistor 294.

The operation of the threshhold networks comprising the operational amplifiers 276 and 278 and the resistors associated therewith is as follows. The variable tap lead 277 establishes an upper threshhold limit while the position of the variable tap 283 on the potentiometer 275 establishes a lower threshhold limit on the gas detection window detectable by the comparators 276 and 278. In the preferred embodiment of the present invention, the upper limit established by lead 277 and potentiometer 274 cannot exceed 2.5 volts since this is the level of the reference potential at reference terminal 107 and the lower limit established by the voltage tap 283 on potentiometer 275 cannot go below zero volts. Assuming therefore that the normal clean air reading indicating the absence of both gases is approximately 1.3 volts, a value of 1.3 volts at node 93 would cause comparator 276 and comparator 278 to output normally low signals indicating the absence of an alarm condition or alternatively, indicating that the detectors 11, 15 have not detected at least some predetermined minimum level of at least one of the undesirable gases, in the preferred embodiment, a combustible gas such as methane and a toxic gas such as hydrogen sulfide, and no alarm signal is to be generated.

The output node 286 of comparator 276 is connected via lead 295 to a second input of the first NOR gate 273 while the output node 284 of the comparator 278 is connected to a corresponding second input of the second NOR gate 274 via lead 296. Node 251, which receives the warm-up status signal from node 133 via lead 252 is commonly connected to the third and final inputs of NOR gates 273 and 274 whose function will be hereinafter described.

The configuration of the threshhold detection circuits including comparators 276 and 278 is such that whenever the error-compensated voltage signal $V_c$ at node 93 is significantly above 1.3 volts, indicating that at least a predetermined quantity or concentration or amount of a first undesirable gas, in the preferred embodiment, a combustible gas such as methane, has been detected by the first detecting element 11, then the output of the comparator switches high and this high signal is representative of an alarm state indicating that more than a predetermined amount of the first undesirable gas has been detected within a given area.

Similarly, whenever the error-compensated electrical output signal $V_c$ at node 93 falls significantly below 1.3 volts, the output of comparator 278 switches to a high state causing a high signal to be outputted at node 284. A high at node 284 indicates the existence of an alarm state such as the detection of at least a predetermined amount or quantity or concentration of a second undesirable gas, in the preferred embodiment a toxic gas such as hydrogen sulfide, has been detected in the given area and this high signal is used to generate an alarm condition indicative thereof as hereinafter described.

The output of the first NOR gate 273 is connected directly to an alarm output node 297 while the output of the second NOR gate 274 is connected to a second alarm output node 298. Node 297 is connected via lead 299 to a first input of a logical NAND gate 300 whose second input is connected to the node 298 via lead 301. The functioning of the NAND gate 300 is such that so long as either of its inputs is low, its output will remain high, but whenever all of its inputs are high, its output will go low.

The output of NAND gate 300 is connected via lead 302 to the input of a low frequency oscillator. The low frequency oscillator includes a first logical NAND gate 303 having one input connected to the lead 302 and its output connected to a common node 304. The common node 304 is connected to both inputs of a second logical NAND gate 305 whose output is connected to an oscillator output node 306. Node 306 is connected to one plate of a capacitor 307 whose opposite plate is connected to a node 308. Node 308 is connected through a resistor 309 back to the common node 304. Node 308 is also connected via lead 311 back to the second input of NAND gate 303 to establish a low frequency oscillator, as known in the art.

The common node 304 is connected via lead 312 to one input of a two input logical NOR gate 313 whose second input is connected via lead 314 to the alarm output node 297 of NOR gate 273 and the output of NOR gate 313 is connected directly to the node 220 previously described. Similarly, the oscillator output node 306 is connected via lead 315 to one input of a two input NOR gate 316. The second input of NOR gate 316 is connected to the alarm output node 298 at the output of NOR gate 274 via lead 317 and the output of NOR gate 316 is connected directly to the node 236 previously described.

Node 220 is connected via lead 318 to the first input of a two input NOR gate 319 whose second input is connected via lead 321 to node 228. The output of the NOR gate 319 is connected via lead 322 to the input of an oscillator configuration which includes a NOR gate 323 and a NOR gate 324. The combination of NOR gates 319, 323 and 324 forms a gated astable multivibrator which can be used as an oscillator when combined with a resistor and capacitor, as hereinafter described, and which can be used to oscillate at a first predetermined frequency. The output of NOR gate 319 is connected via lead 322 to the first input of a two input NOR gate 323 whose output is connected directly to a common node 325. Node 325 is commonly connected to both inputs of NOR gate 324 and the output of NOR gate 324 is connected to one plate of a capacitor 326 whose opposite plate is connected to a node 327. Node 327 is connected through a resistor 328 back to the common node 325. Node 327 is also connected via lead 329 back to the second input of NOR gate 323 while the common node 325 is connected via lead 331 to one input of the two input NOR gate 254 previously described.

Similarly, the output node 236 is connected to the input of another gated astable multivibrator combination forming a second oscillator configuration selected to oscillate at the same or a different predetermined frequency for use as hereinafter described and includes NOR gates 332, 333 and 334. Node 236 is connected via lead 335 to the first input of a two input NOR gate 332 whose output is connected via lead 336 to the first input of a two input NOR gate 333. The output of NOR gate 333 is connected to a common node 337 and common node 337 is connected to both inputs of NOR gate 334. The output of NOR gate 334 is connected directly to one plate of a capacitor 338 whose opposite plate is connected to a node 339. Node 339 is connected via lead 341 to the second input of NOR gate 333 while the common node 337 is connected via lead 343 to the second input of NOR gate 254. The second input of NOR gate 332 is connected to node 214 via lead 344.

Briefly, the operation of the gated oscillators and alarm generating circuitry of FIG. 5 will now be described. As previously described, during normal operation, the green LED 223 is illuminated. Whenever a low voltage condition is detected, a high signal appears at node 122 and this signal turns off transistor 221 to turn off the green LED 223 as previously described. Furthermore, the high at node 228 is supplied via lead 321 to one input of NOR gate 319. Since we have not detected the presence of a combustible gas, as hereinafter described, the signal at node 220 is low causing a low to appear at the second input of NOR gate 319 via lead 318. With a low at one of its inputs and a high at the other, the output of NOR gate 319 goes high and this high is supplied via lead 322 to one input of NOR gate 323. So long as the signal on lead 322 to NOR gate 323 remains high, the oscillator remains locked in a fixed state and the signal at the common node 325 is high. The high at node 325 is transmitted via lead 331 to one input of NOR gate 254.

Simultaneously, the signal at node 214 is low since we have not detected an oxygen deficient condition and this signal is supplied via lead 344 to one input of NOR gate 332 to enable same while a similar low appears at node 236 and is transmitted to the second input of NOR gate 332 via lead 335 since we have not detected the presence of a toxic gas such as hydrogen sulfide either. With both of its inputs low, the output of NOR gate 332 goes high and with the high presented via lead 336 to one input of NOR gate 333, this oscillator is also locked causing the common node 337 to go low. The low at node 337 is supplied via lead 343 to the second input of NOR gate 254 and with both of its inputs low, the output of NOR gate 254 goes high causing transistor 239 to conduct continuously. Providing that the warm-up period has elapsed so that transistor 238 is already conductive, the conduction of transistor 239 establishes a conductive path between the +6 volt supply lead 102 and the negative grounding lead 39 so as to cause the warning horn to sound continuously so that the combination of the absence of the green light 223 and the continuous sounding of the horn 242 indicates the detection and unique identification of a low voltage alarm condition.

Also, as previously described, whenever a deficiency of oxygen is detected, a high is caused to appear at node 208 causing transistor 212 to conduct and LED 211 to illuminate yellow as a visual indication of the condition of oxygen deficiency. Simultaneously, the high from node 208 is supplied via lead 213 to node 214 and via node 214 and lead 344 is transmitted to one input of NOR gate 332 causing its output to go low. The low on node 336 enables one input of NOR gate 333 and enables the oscillator comprising NOR gates 333 and 334 together with the capacitor 338 and 339 to generate an off and on signal at the common node 337 at the frequency established by the RC time constant of resistor 340 and capacitor 338, as known in the art. The signal from node 337 is transmitted via lead 343 to one input of NOR gate 254. Simultaneously, since there is no low voltage condition, the signal present at node 228 is high and this is presented via lead 321 to one input of NOR gate 319 causing its output to go low. With a low at lead 322, the oscillator comprising NOR gates 323 and 324 together with capacitor 326 and resistor 323, 328 is operable and the off and on signal at node 325 is connected via lead 331 back to the second input of NOR gate 254. Each time the lows or offs correspond, the output of NOR gate 254 goes high to activate the horn 242 so that the horn sounds almost continuously but in an oscillating manner while the yellow light remains continuously on as a unique indication of the existence of the oxygen deficiency alarm state.

Next, consider the case where the first semiconductor catalytic gas sensing devices 11 detects the presence of at least a predetermined amount of a combustible gas such as methane causing the output node 286 of comparator 276 to go high. The high at the output node 286 is transmitted via lead 295 to one input of NOR gate 273 causing a low to appear at its alarm output node 297. The low at node 297 serves two purposes. In the first place, the low is supplied via lead 299 to one input of NAND gate 300 causing its output to go high. With a high on lead 302, the oscillator comprising NAND gates 303 and 305 together with capacitors 307 and resistor 309 is enabled so that out of phase on and off signals are generated on leads 312 and 315 respectively at a predetermined (usually different) frequency.

Simultaneously, the low from node 297 is supplied to one input of NOR gate 313 so that each time its other input goes low with the ever-changing signal from lead 12 from the oscillator of NAND gates 303, 305, etc., a high appears at node 220 and each time the signal on lead 312 goes high, a high appears at node 220. Since this alternating high and low signal is transmitted via resistor 219 to control transistor 218, the red LED 217 is caused to flash on and off at a distinctive frequency as a visual indication of the detection of the combustible gas.

Furthermore, the alternating high and low signal is transmitted via lead 318 to one input of NOR gate 319. Since there is no low voltage condition, the signal on node 228 remains high causing the output of gate 322 to be low so as to enable the oscillator comprising NOR gates 323, 324, etc., to be operative. Therefore, an on and off signal at a predetermined frequency is generated at the common node 325 and this signal is transmitted via lead 331 to one input of NOR gate 254. Simultaneously, since no other gas was detected, the output of NOR gate 274 remains high causing the output of NOR gate 316 to remain low to enable one input of NOR gate 332. Further, since there is no oxygen deficiency condition, a low is present at node 214 causing the other input of NOR gate 332 to go low. With both inputs of NOR gate 332 low, a high appears on lead 336 and with a high present at one of the inputs of NOR gate 333, a low is continuously present at node 337. The low at node 337 is connected via lead 343 to the other input of NOR gate 254 for enabling same so that as the on and off oscillation signal at the first predetermined frequency of the oscillator comprising NOR gates 323, 324, etc., is received at the other input of NOR gate 254 via lead 331, transistor 239 is turned off and on causing the audio alarm, horn, or siren 242 to give off an audio alarm at said frequency indicative of the detection of said combustible gas. Simultaneously, the presence of a low signal at node 236 insures that the orange LED indicative of the presence of a detected toxic gas remains off.

Similarly, if the second semiconductor catalytic gas-sensing device 15 detects the presence of at least a predetermined concentration of the second undesirable gas, for example a toxic gas such as hydrogen sulfide, the output of comparator 278, which appears at node 284, will go high causing the output of NOR gate 274 to go low. This low will appear at node 298 and serve several purposes. In the first place, the low at node 298 will be supplied via lead 301 to one input of NAND gate 300 causing the output of NAND gate 300 to go high. A high at the output of NAND gate 300 will appear on lead 302 and enable one input of NAND gate 303 so as to cause the oscillator comprising NAND gates 303, 305 and related circuitry to oscillate at its predetermined frequency causing the signal at node 306 to go on and off at said frequency. Node 306 is connected via lead 315 to one input of NOR gate 316 and will go on and off or high and low at said frequency.

Simultaneously, the low from node 298 is supplied via lead 317 to the opposite input of NOR gate 316 for enabling same. The output of NOR gate 316 will, therefore, go on and off at the frequency of the oscillator comprising NAND gates 303, 305, etc. causing alternating high and low signals to appear at node 236. The alternating high and low signals at node 236 will be transmitted through resistor 235 to cause control transistor 234 to turn on and off thereby alternately turning the orange LED 233 on and off to provide a distinct visual alarm indication of the detection of a toxic gas such as hydrogen sulfide Simultaneously, the on and off signal from node 236 will be supplied via lead 335 to one input of NOR gate 332. The other input of NOR gate 332 is taken from node 214 via lead 344 and will remain low since we are not in a oxygen deficiency situation. Therefore, with one input of NOR gate 332 continuously enabled and the opposite input alternately enabled, an on and off signal will appear on lead 336 to alternately enable and disable NOR gate 333 to operate the oscillator comprising NOR gate 333, 334, etc., thereby causing the signal at node 337 to alternately turn on and off. This on and off signal is transmitted via lead 343 to one input of NOR gate 254.

Further, since no low voltage condition exists, the low which is continuously present on lead 229 is sensed via lead 228 and leads 321 at one input of NOR gate 319 causing its output to be maintained low. A low on lead 322 continuously enables gate 323 and causes the signal at node 325 to turn off and on at the frequency of the oscillator comprising NOR gates 323, 324, etc. This on and off signal is supplied via lead 331 to the other input of NOR gate 254 causing transistor 239 to turn off and on at still a different frequency to produce still a different tone or audio alarm at the speaker 242 which, together with the blinking orange LED 233 constitutes a distinctive audio and visual alarm indication of the detection of the existence of at least a predetermined amount of toxic gas.

During the initial warm-up, as previously indicated, the signal at node 133 remains high causing a low to appear at the output of both NOR gates 273 and 274. With a low at both outputs, both the red and the orange LEDs will blink on and off during the initial warm-up phase but, as previously described, the horn 242 will be rendered inoperative by the turning off of transistor 238, as previously described.

Lastly, if the combination detection circuit causes a high to appear at node 272, the output of both NOR gates 273 and 274 will again be caused to go low. Under these circumstances, both the red and the orange LEDs will blink on and off at the predetermined frequencies but, in addition, the oscillator circuit comprising NOR gates 323, 324, etc., and the oscillator circuit comprising NOR gates 333, 334, etc, will be rendered operative causing the transistor 339 to be alternately turned on and off to operate the horn 242 to generate an audio alarm as well. Therefore, the existence of an oscillating audio alarm together with both a blinking orange and a blinking red light distinctively indicate the existence of the detection of a combination of both the combustible and toxic gases or in the alternative, some third gas to which both sensing elements 11 and 15 are responsive, such as carbon monoxide or the like, as previously described.

With this detailed description of the method and apparatus of the present invention it will be understood that various circuits can be used to utilize error tendencies inherent in one semiconductor catalytic gas-sensing element to offset similar errors in another in such a manner so as to produce a highly accurate and reliable error-compensated signal indicative thereof, and various circuit means may be used to sense the overall reaction of the combined semiconductor sensors to detect a combination of the gases or the presence of still a third undesirable gas and generate the same or unique and distinct alarm indications indicative thereof, if desired.

With this detailed description a specific circuitry used to illustrate the preferred embodiment of the present invention and the operation thereof, it will be obvious to those skilled in the art that various modifications can be made in the circuitry and means for implementing the method and apparatus of the present invention without departing from the spirit and scope of the present invention which is limited only by the appended claims.

We claim:

1. Apparatus for detecting and indicating the presence of at least a predetermined minimum concentration of at least one undesirable gas within a given area comprising:

a first semiconductor gas-sensing means having at least one electrical property which changes significantly in response to the presence of said at least a predetermined minimum concentration of said at least one undesirable gas, said electrical property tending to vary with changes in at least one of conditions such as temperature, relative humidity and drift;

a second semiconductor gas-sensing means having a similar electrical property which changes significantly in response to the presence of a different gas but changes less significantly in response to the presence of said at least one undesirable gas, said similar electrical property also tending to vary with changes in at least one of said conditions such as temperature, relative humidity and drift;

electrical circuit means responsive to said electrical property of said first and second semiconductor gas-sensing means for generating at least one reliable electrical output signal compensated for variations in such changes as temperature, relative humidity and drift, said error-compensated electrical output signal being generally indicative of the relative concentration of said at least one undesirable gas, at least in the absence of significant concentrations of said different gas;

means for establishing at least one predetermined threshold range indicative of less than said predetermined minimum concentration of said at least one undesirable gas;

means responsive to said compensated electrical output signal being beyond said established threshhold range for indicating the presence of at least said predetermined minimum concentration of said at least one undesirable gas within said given area for alarm purposes, and means responsive to said error-compensated electrical output signal being within said established threshhold range for indicating the presence of at least a predetermined minimum concentration of said different gas within said given area for alarm purposes.

2. A portable gas detection apparatus for detecting and indicating the presence of undesirable concentrations of first or second gases within a given environmental space comprising:

a first semiconductor catalytic gas-sensing device having a normal electrical resistance under normal environmental conditions, said first semiconductor catalytic gas-sensing device being responsive to at least a predetermined concentration of said first gas such that the electrical resistance thereof decreases significantly with increased relative concentrations of said first gas and decreases less significantly with increases in the relative concentration of said second gas, the electrical resistance of said first semiconductor catalytic gas-sensing device also tending to vary with changes in temperature, relative humidity or age so as to render the value of said electrical resistance relatively unreliable as an indication of the relative concentration of said first gas;

a second semiconductor catalytic gas-sensing device having a normal electrical resistance under normal environmental conditions, said second semiconductor catalytic gas-sensing device being responsive to at least a predetermined concentration of said second gas such that the electrical resistance thereof decreases significantly with increased relative concentrations of said second gas and decreases less significantly with increases in the relative concentration of said first gas, the electrical resistance of said second semiconductor catalytic gas-sensing device also tending to vary with changes in temperature, relative humidity or age so as to render the value of said electrical resistance relatively unreliable as an indication of the relative concentration of said second gas;

means for supplying a source of relatively constant current;

circuit means for coupling said first and second semiconductor catalytic gas-sensing devices in series with said current source;

compensation circuit means including bridge circuit means coupled across said series-coupled first and second semiconductor catalytic gas-sensing devices and to said circuit means such that variations in the electrical resistance of said first semiconductor catalytic gas-sensing device with changes in temperature, relative humidity and age are substantially cancelled out by corresponding variations in the electrical resistance of said second semiconductor catalytic gas-sensing device with said changes in temperature, relative humidity and age, said compensation circuit means being responsive to the electrical resistance of said first and second semiconductor catalytic gas-sensing devices for generating a relatively reliable error-compensated electrical output signal indicative of the relative concentration of one of said first and second gases, at least in the relative absence of the other;

means for establishing a threshhold level; and means responsive to said error-compensated electrical output signal being greater than said established threshhold level for generating a first alarm state indicative of the presence of an undesirable concentration of said first gas and being responsive to said compensated electrical output signal being less than said established threshhold level for generating a second alarm state indicative of the presence of an undesirable concentration of said second gas.

3. The portable gas detection apparatus of claim 2 wherein said bridge circuit means includes a first resistive means having a variable tap connected in parallel across said first and second serially-connected semiconductor catalytic gas-sensing devices, a second resistive means having a variable tap connected in parallel across said first resistive means, a first bridge output means connected to said circuit means at the junction of said first and second serially connected semiconductor catalytic gas-sensing devices and simultaneously to said tap of said first resistive means such that said tap may be selectively varied to balance the normal electrical resistance of said first and second semiconductor catalytic gas-sensing devices under normal environmental operating conditions and a second bridge output means connected to the tap of said second resistive means, said tap of said second resistive means being selectively variable to establish a zero difference threshhold under normal environmental operating conditions; and wherein said means for establishing a threshhold level includes a first comparator having one input coupled to said second bridge output means and a comparator output; and wherein said alarm generating means includes a differential amplifier means having one input resistively coupled to said comparator output for establishing said threshold level, a second input for receiving the compensated electrical output signal from the first output means of said bridge circuit means, and a differential amplifier output for outputting a first range of electrical signals representative of said first alarm state, said first range of electrical signals being generally proportional to the detected concentration level of said first undesirable gas within said given environmental space and a second range of electrical signals representative of said second alarm state, said second range of electrical signals being generally proportional to the detected concentration level of said second undesirable gas within said gas environmental space.

4. The portable gas detection apparatus of claim 3 wherein said means for generating said alarm states further includes a first comparator means having a first input means for establishing a minimum threshhold level and a second comparator input for receiving said first and second ranges of electrical signals, said first comparator means being responsive to said first range of electrical signals representative of said first alarm state being greater than said first minimum threshhold for generating a first alarm initiating signal; second comparator means having first input means for establishing a maximum threshhold and a second input means for receiving said first and second ranges of electrical signals, said second comparator means being responsive to said second range of electrical signals representative of said second alarm state being less than said established maximum threshhold level for generating a second alarm initiating signal; and alarm indication means responsive to said first alarm initiating signal for emitting a first alarm signal indicative of the presence of at least said predetermined concentration of said first undesirable gas and responsive to said second alarm initiating signal for emitting a second different and distinct alarm signal indicative of the presence of at least said predetermined concentration of said second undesirable gas.

5. The portable gas detection apparatus of claim 2 wherein said first gas is a combustible gas such as methane and said second gas is a toxic gas such as hydrogen sulfide and wherein said apparatus includes circuit means responsive to the presence of undesirable combined concentrations of both said first and said second gases for indicating an alarm condition.

6. The portable gas detection apparatus of claim 2 further including a first visual and audio alarm means responsive to said first alarm condition for indicating the presence of an undesirable concentration of said first gas and second different and distinct visual and audio alarm means responsive to said second alarm state for indicating the presence of an undesirable concentration of said second gas.

7. The portable gas detection apparatus of claim 2 wherein both of said first and second semiconductor catalytic gas-sensing devices include heating means and said gas detection apparatus includes heater circuit means therefor; said heating means including a heating element in each of said first and second semiconductor catalytic gas-sensing devices, means for connecting one terminal of the heating element of said first semiconductor catalytic gas-sensing device to one terminal of said second semiconductor catalytic gas-sensing device in a series configuration and means for connecting the opposite terminals of said heating elements to a common current input node, said heater circuit means including a source of supplied voltage, current control means connecting said source of supply voltage to said common current input node for supplying a controlled current thereto; comparator means including a first input connected to establish a heater current reference, feedback means coupled to the junction of said serially connected heater elements and to the other input of said comparator means such that said control means is responsive to the output of said comparator means for controlling the amount of heater current supplied to said common current input node.

8. The portable gas detection apparatus of claim 7 wherein said gas detection apparatus further includes means for timing a predetermined warm-up period and for generating a control signal at the expiration thereof and wherein said feedback means includes resistive means normally coupled between the junction of said heating elements and ground for reducing the amount of current supplied to said heater elements by increasing the control voltage at said second input of said heater comparator and means for normally by-passing said resistive means during initial warm-up for increasing the current flow to said heater elements but responsive to the generation of said signal indicative of the expiration of said warm-up period for terminating said by-pass and permitting said resistive means to decrease the amount of current supplied to said heater elements.

9. The portable gas detection apparatus of claim 2 wherein said means for supplying a source of relatively constant current to the combination of said first and second serially-connected semiconductor catalytic gas-sensing devices and said compensation circuit means includes Howland circuit means including an operational amplifier having its output resistively coupled back to one of its inputs which in turn is coupled back to the junction of one terminal of said first and second seriallycoupled semi-conductor catalytic gas-sensing devices and said bridge circuit means for supplying said relatively constant current thereto.

10. The portable gas detection apparatus of claim 9 wherein said means for supplying a source of relatively constant current further includes a gain amplifier, resistive means coupled between the source of potential and ground, means for varying said resistive means for establishing a gain threshhold at one input of said gain amplifier, means connecting the other input of said gain amplifier to said one input of the operational amplifier of said Howland circuit means, the output of said gain amplifier being resistively coupled to the junction of said one input of the operational amplifier of said Howland circuit means and the resistive means coupling the output of said operational amplifier thereto, the output of said gain amplifier being further connected to ground through a variable resistive means; and comparator means having one input resistively coupled to variable resistive means and its opposite input resistively coupled to a source of potential to establish a gain reference such that said comparator outputs a combination alarm signal whenever undesirable concentrations of a combination of both said first and second gases are detected even though the simultaneous detection thereof will tend to void the accuracy of said error-compensated electrical output signal.

11. The portable gas detection apparatus of claim 2 wherein said first gas is a combustible gas such as methane and said second gas is a toxic gas such as hydrogen sulfide and wherein both of said first and second semiconductor catalytic gas-sensing devices are moderately responsive to undesirable concentrations of a third gas such as carbon monoxide for decreasing the electrical resistances thereof with increases in concentrations of said third gas; and wherein said portable gas detection apparatus includes circuit means responsive to the uncompensated combined drop in the resistances of both said first and second semiconductor catalytic gas-sensing devices for generating an alarm signal indicative of the presence of an undesirable concentration of said third gas within a given environmental space.

12. The portable gas detection apparatus of claim 2 wherein said first gas is a combustible gas such as methane and said second gas is a toxic gas such as hydrogen sulfide and wherein said first and second semiconductor catalytic gas-sensing devices respond to undesirable concentrations of combined combustible and toxic gases for decreasing the resistances thereof and said portable gas detection apparatus includes circuit means responsive to the uncompensated resistance drop in said first and second semiconductor catalytic gas-sensing devices for generating a combination alarm signal indicative of the existence of undesirable concentrations of a combination of both combustible and toxic gases.

13. The portable gas detection apparatus of claim 2 further including means for detecting a condition of oxygen deficiency, said oxygen deficiency detecting means including detection means responsive to the concentration of oxygen in a given atmosphere for generating an electrical signal indicative thereof; temperature compensation means for compensating the electrical output of said oxygen deficiency detecting means for variations in temperature; alarm indication means responsive to the detection of an oxygen deficient condition for generating an alarm signal distinctively indicative thereof; and means for automatically calibrating said oxygen deficiency circuit means to required standards.

14. The portable gas detection apparatus of claim 13 wherein said oxygen deficiency sensing means is spaced in close proximity to at least one of said first and second semiconductor catalytic gas-sensing devices for enabling said oxygen deficiency sensing circuit to be utilized at temperatures far below the normal operating range of such oxygen deficiency means due to the presence of the heat emitted by said semiconductor catalytic gas-sensing devices tending to warm said oxygen deficiency sensing means to enable it to be used down to temperatures of approximately zero degrees Fahrenheit.

15. The portable gas detection apparatus of claim 13 wherein said alarm state indicating means includes a first visual indicator for indicating a normal operating condition; a second normally-off different and distinct visual indicator responsive to the presence of an undesirable concentration of said first gas for turning on to indicate same; a third different and distinct normally-off visual indicator responsive to the detection of an undesirable concentration of said second gas for turning on to indicate the presence of same; a fourth different and distinct normally-off visual indicator responsive to the detection of a condition of deficient oxygen for turning on to indicate said oxygen deficient condition; speaker means for generating an audible alarm signal; a first oscillator circuit means responsive to the detection of a low voltage condition for causing said speaker means to generate a continuous tone and responsive to the generation of said alarm signal indicative of an undesirable concentration of said first gas for generating an oscillating audio alarm tone having a first frequency; a second oscillator circuit means responsive to the detection of said oxygen deficient condition for enabling said speaker means to generate a continuous oscillating audio tone and responsive to the generation of said signal indicative of an undesirable concentration of said second gas for causing said speaker means to output a second different and distinct audio alarm signal having a second oscillating frequency; said gas detection apparatus including circuitry responsive to the detection of an undesirable concentration of a combination of both said first and second gases for turning both of said second and third visual alarm means and said speaker means at both said first and second oscillating frequencies simultaneously.

16. The portable gas detection apparatus of claim 2 wherein said gas-sensing devices include heating elements and wherein said apparatus includes warm-up circuit means for initially supplying increased current to the heater elements of said semiconductor catalytic gas-sensing elements; timing means for generating a control signal when a sufficient warm-up period has elapsed; and means responsive to said control signal for reducing the current supplied to the heating elements of said semiconductor catalytic gas-sensing devices.

17. The portable gas detection apparatus of claim 2 further including a power supply; means for generating an alarm signal when said power supply reaches a predetermined dangerously low voltage condition; and means responsive to the detection of said predetermined dangerous low voltage condition for generating an alarm signal indicative thereof.

18. Apparatus for detecting and indicating the presence of non-insignificant quantities of at least first and second undesirable gases comprising:

a first semiconductor gas-sensing means responsive to increases in the concentration of said first undesirable gas for significantly reducing its electrical resistance and responsive to increases in the concentration of said second undesirable gas for less significantly reducing its electrical resistance;

second semiconductor gas-detecting means responsive to increases in the concentration of said second undesirable gas for significantly decreasing the electrical resistance thereof and responsive to increases in the concentration of said first undesirable gas for less significantly reducing its electrical resistance, the electrical resistances of both of said first and second semiconductor gas-detecting means having a tendency to vary with changes in conditions such as temperature, relative humidity, age and the like;

means including a Howland circuit for supplying current to said first and second semiconductor gas-detecting means;

electrical circuit means coupled to said first and second semiconductor gas-detecting means such that errors due to variations in the resistance of one of said semiconductor gas-detecting means with changes in conditions such as temperature, relative humidity, age or the like will cancel out errors due to variations in the resistance of said second semiconductor gas detection means with changes in said conditions such as temperature, relative humidity, aging or the like for generating an error-compensated output signal indicative of the presence and relative concentration of non-insignificant quantities of one of said first and second undesirable gases, at least in the relative absence of the other of said undesirable gases, means for establishing at least one predetermined threshhold level indicative of less than a non-insignificant quantity of one of said first and second undesirable gases, and means responsive to said error-compensated output signal being greater than said established threshhold level thereby indicating the non-insignificant presence of one of said first and second undesirable gases and means responsive to said error-compensated output signal being less than said established threshhold level thereby indicating the non-insignificant presence of the other of said first and second undesirable gases.

19. The gas detecting apparatus of claim 18 further including means responsive to non-insignificant quantities of a combination of both of said first and second undesirable gases for generating an alarm signal indicative thereof.

20. In an apparatus for sensing the presence of a first undesirable gas in a given environmental area and for providing an alarm indication indicative thereof whenever the detected concentration of said first undesirable gas exceeds a predetermined acceptable level, said apparatus including a first semiconductor gas-sensing device having a measurable electrical property which varies significantly as the concentration of said first undesirable gas increases and means responsive to changes in said electrical property for generating an alarm indication indicative of said concentration of said first undesirable gas, said electrical property also varying with other changing conditions such as temperature, relative humidity, aging and the like so as to render such alarm indications relatively unreliable; the improvement comprising:

a second semiconductor gas sensing device having said measurable electrical property which varies less significantly as the concentration of said first undesirable gas increases but wherein said electrical property varies in substantially the same manner with said changing conditions such as temperature, relative humidity, aging and the like;

Howland circuit means for providing current to said first and second semiconductor gas-sensing devices;

circuit means for coupling said first and second semiconductor gas-sensing devices so as to cancel out the errors due to variations in said electrical property with said changes in said other conditions such as temperature, relative humidity, aging and the like to produce a relatively accurate, error-compensated alarm signal indicative of the presence of at least a predetermined concentration level of said first undesirable gas in a given environmental area; and wherein said second semiconductor gas-sensing device further exhibits a relatively significant change in said electrical property with increases in the concentration of a second undesirable gas but said first semiconductor gas-sensing device exhibits a less significant change in said electrical property with increased concentrations of said second undesirable gas; wherein the improvement further comprises a first circuit means responsive to said error-compensated alarm signal for generating a first alarm signal indicative of at least a predetermined concentration level of said first undesirable gas in a given environmental area and a second circuit means for generating a second alarm signal indicative of at least a predetermined concentration level of a second undesirable gas in said given environmental area; and wherein said improvement further comprises second circuit means responsive to a predetermined increase in the combined concentration levels of said first and second undesirable gases beyond said predetermined individual concentration levels for generating a third alarm signal indicative thereof.

* * * * *